US007810901B2

(12) United States Patent
Akiyama

(10) Patent No.: US 7,810,901 B2
(45) Date of Patent: Oct. 12, 2010

(54) DRIVING APPARATUS

(75) Inventor: Shigeki Akiyama, Ichinomiya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 191 days.

(21) Appl. No.: 11/421,253

(22) Filed: May 31, 2006

(65) Prior Publication Data

US 2006/0268043 A1 Nov. 30, 2006

(30) Foreign Application Priority Data

May 31, 2005 (JP) ..... 2005-159966

(51) Int. Cl.
*B41J 23/00* (2006.01)

(52) U.S. Cl. ..... 347/37; 347/5; 347/9

(58) Field of Classification Search ..... 347/5, 347/9, 10–12, 19, 37, 40–43; 341/13
See application file for complete search history.

(56) References Cited

U.S. PATENT DOCUMENTS

| | | | | |
|---|---|---|---|---|
| 4,543,590 A * | 9/1985 | Tazaki et al. | ..... | 347/43 |
| 5,434,602 A | 7/1995 | Kaburagi et al. | | |
| 5,563,591 A * | 10/1996 | Jacobs et al. | ..... | 341/13 |

FOREIGN PATENT DOCUMENTS

| | | |
|---|---|---|
| JP | S63-162258 A | 7/1988 |
| JP | H05-069626 A | 3/1993 |
| JP | H5338307 | 12/1993 |
| JP | H08-025742 A | 1/1996 |
| JP | 2000280555 | 10/2000 |
| JP | 3093536 U | 2/2003 |
| JP | 200425549 | 1/2004 |
| JP | 2004153947 | 6/2004 |

OTHER PUBLICATIONS

Japanese Patent Office; Notice of Reason(s) of Rejection in Japanese Patent Application No. 2005-159966 (counterpart to the above-captioned U.S. patent application) mailed Jun. 8, 2010.

* cited by examiner

*Primary Examiner*—Lam S Nguyen
(74) *Attorney, Agent, or Firm*—Baker Botts L.L.P.

(57) ABSTRACT

A driving apparatus, including a driving device which moves an object along a predetermined path; a linear encoder including a linear scale and a detector one of which is moved relatively to the other when the object is moved along the predetermined path; a control device which controls, based on an output of the detector, the driving device to move the object along the predetermined path; and at least one stopper which engages, when the object is moved along the predetermined path, the object and thereby stops a further movement of the object. The linear scale includes at least one first scale portion having a plurality of first detectable portions provided at a predetermined pitch, and at least one second scale portion having a plurality of second detectable portions including at least one pair of adjacent second detectable portions which are adjacent to each other and which are distant from each other by a predetermined distance smaller than the predetermined pitch. The first scale portion and the second scale portion are located relative to each other such that when the object is moved toward the stopper, the detector first detects the first detectable portions and then detects the second detectable portions, while sequentially outputting a plurality of detection signals, and the control device controls, based on the detection signals, the driving device to move the object along the predetermined path.

31 Claims, 19 Drawing Sheets

DIFFERENCE VALUES diff v AROUND RESOLUTION-CHANGE POINT C

DIFFERENCE VALUES diff v AROUND IMPACT POINT A

DRIVING APPARATUS

The present application is based on Japanese Patent Application No. 2005-159966 filed on May 31, 2005, the contents of which are incorporated herein by reference.

BACKGROUND OF THE INVENTION

1. Field of the Invention

The present invention relates to a driving apparatus including a driving device that drives or moves an object such as a carriage, a linear encoder, and a control device or portion that controls, based on an output of the linear encoder the driving device to move the object.

2. Discussion of Related Art

There has been known a linear driving apparatus which includes a linear motor, or a combination of a rotary motor and a converting device that converts a rotary driving force of the rotary motor into a linear motion, and which linearly drives or moves an object by utilizing the linear motion. Generally, this sort of linear driving apparatus performs a so-called feedback control in which a position or a velocity of the object is detected and the motor, or the linear movement of the object is controlled based on the detected result.

A serial-type printer such as an ink-jet printer employs the above-indicated linear driving apparatus that performs the feedback control. The serial-type printer includes a carriage that carries a printing or recording head, and reciprocates the carriage in a main scan direction perpendicular to a sub-scan direction in which a recording sheet is fed, so as to record an image on the sheet.

The serial-type printer additionally includes a linear encoder that detects, during an image recording operation of the recording head, a position or a velocity of the carriage so as to control the velocity of the carriage to a constant value. The feedback control of the carriage is performed based on a detection signal outputted by the linear encoder.

There have been known various sorts of linear encoders each of which detects a position or a velocity of a carriage; such as an optical linear encoder or a magnetic linear encoder. Generally, each sort of linear encoder includes a linear scale having a plurality of detectable portions arranged at a regular interval of distance; and a detector that reads or detects each of the detectable portions in a manner specific to said each sort. For example, in the case of the optical linear encoder, the linear scale thereof has, as the detectable portions, a plurality of slits, or a plurality of reflectors, that are arranged at a regular interval of distance; and in the case of the magnetic linear encoder, the linear scale thereof has, as the detectable portions, a plurality of north (N) poles and a plurality of south (S) poles that are alternately arranged at a regular interval of distance. When the object such as the carriage is moved, the detectable portions of the linear scale are read by the optical or magnetic detector, so as to detect an amount of movement of the object.

The serial-type printer is required to carry out accurately various operations such as the image recording operation. To this end, the serial-type printer needs to detect not only the amount of movement of the object but a position of the same relative to the linear driving apparatus, e.g., a housing or a frame of the printer. Generally, the printer carries out, at an appropriate timing, a so-called origin or home-position detecting operation to detect an origin or a home position (i.e., a reference position) of the carriage, and determines, based on the detected home position, a current position of the carriage. This serial-type printer is disclosed by, e.g., Japanese Patent Application Publication No. 2004-25549.

The home-position detecting operation is carried out such that the carriage is moved to engage or contact a side frame of the printer and is physically locked or stopped by the same. FIG. 19 shows a graph representing respective time-wise changes of an actual velocity of the object i.e., the carriage), a detected (i.e., calculated) velocity of the carriage, detected (i.e., calculated) based on the encoder signal outputted by the linear encoder, and a motor driving or operating amount (i.e., an electric current supplied to the motor), each in the home-position detecting operation.

As shown in FIG. 19, in a steady state after the start of the home-position detecting operation and before a time point, A, i.e., 4 seconds after the start, the carriage (the object) is moved at a substantially constant velocity (i.e., 5 inches/sec.) and the motor operating amount is kept at a substantially constant value. At the time point A, the carriage impacts on the side frame, and the movement of the carriage is stopped by the frame. Thus, the detected velocity of the carriage is lowered to zero and accordingly the motor operating amount is increased to an upper limit amount (i.e., 25, shown in FIG. 19), i.e., is saturated, so as to move the carriage at the target velocity. If this saturated state continues for a predetermined time period, B (e.g., 0.5 second), then it is judged that the carriage has impacted on the side frame and the current position of the carriage, indicated by a number counted based on the encoder signal, is determined as the home position (the origin) of the carriage, that is, the counted number is reset to zero.

SUMMARY OF THE INVENTION

However, in the above-described home-position detecting operation, the carriage needs to be impacted on the side frame of the printer, and the impaction may damage the components of the printer and/or may produce noise. To solve this problem, the conventional printer is adapted to move, in the home-position detecting operation, the carriage at a lowered velocity, or employs a sensor that is provided at a detection position before the home position and detects that the carriage has reached the detection position. In the latter case, when the carriage reaches the detection position, then the carriage is moved at a lowered velocity. Thus, in each case, the impact force produced when the carriage impacts on the side frame is reduced.

However, in the above-indicated former case, the carriage is moved at the lowered velocity till it impacts on the side frame, irrespective of where the movement of the carriage is started. Therefore, the home-position detecting operation takes a long time, which leads to lowering the operation efficiency of the printer, such as the efficiency of the image recording operation.

In the above-indicated latter case, the increase of the time taken by the home-position detecting operation can be minimized, but the sensor is additionally needed. In addition, the printer needs to be modified to be able to control the motor operating amount based on the result detected by the sensor, which leads to increasing the size and production cost of the printer.

It is therefore an object of the present invention to solve at least one of the above-indicated problems. It is another object of the present invention to provide a driving apparatus which includes a linear encoder that detects a position of an object and accurately drives or moves the object based on an output of the encoder, and which additionally includes a stopper that engages the object and thereby stops a further movement of the object, without needing to complicate a construction of the driving apparatus or lower an operation efficiency thereof while an impact force produced when the object impacts on the stopper is reduced. It is another object of the present invention to provide a driving apparatus which includes a linear encoder and a stopper and which carries out a reference-position detecting operation to detect a reference position of an object based on a current position of the object at the time when the object being moved is impacted on, and stopped by, the stopper.

The above objects may be achieved according to the present invention. According to a first aspect of the present invention, there is provided a driving apparatus, comprising a driving device which moves an object along a predetermined path; a linear encoder including a linear scale and a detector at least one of which is moved relatively to an other of the linear scale and the detector when the object is moved along the predetermined path by the driving device; a control device which controls, based on an output of the detector, the driving device to move the object along the predetermined path; and at least one stopper which engages, when the object is moved along the predetermined path, the object and thereby stops a further movement of the object. The linear scale includes at least one first scale portion having a plurality of first detectable portions provided at a first predetermined pitch, and at least one second scale portion having a plurality of second detectable portions including at least one pair of adjacent second detectable portions which are adjacent to each other and which are distant from each other by a predetermined distance smaller than the predetermined pitch. The first scale portion and the second scale portion are located relative to each other such that when the object is moved toward the stopper, the detector first detects the first detectable portions and then detects the second detectable portions, while sequentially outputting a plurality of detection signals, and the control device controls, based on the detection signals, the driving device to move the object along the predetermined path.

In this driving apparatus, the second scale portion of the linear scale has the plurality of second detectable portions including at least one pair of adjacent second detectable portions which are distant from each other by the first predetermined distance smaller than the first predetermined pitch at which the plurality of first detectable portions of the first scale portion are provided. That is, a resolution of the second scale portion is higher than a resolution of the first scale portion. Thus, the object can be moved a lowered velocity before the object impacts on the stopper. Therefore, the object can be accurately moved based on the detection signals of the encoder, without needing to complicate a construction of the driving apparatus or lower an operation efficiency thereof, while an impact force produced when the object impacts on the stopper is reduced.

In this driving apparatus, the control device may include a velocity obtaining portion which obtains, based on the detection signals and a reference value, velocities of the object, and the control device may control, based on the obtained velocities of the object, the driving device to move the object along the predetermined path, such that the object is moved at least one first actual velocity in at least one first path portion of the predetermined path that corresponds to the at least one first scale portion, and is moved at least one second actual velocity lower than the at least one first actual velocity, in at least one second path portion of the predetermined path that corresponds to the at least one second scale portion. The reference value may be a reference pitch, or a reference time. The reference pitch may be equal to the above-indicated first predetermined pitch greater than the first predetermined distance. A velocity of the object may be obtained by dividing the reference pitch by a time period between each pair of adjacent detection signals, or by counting a total number of the detection signal or signals produced during the reference time. The reference value is commonly used for the first and second scale portions of the linear scale. Therefore, when the object is moved in the second path portion of the predetermined path, the velocity of the object, obtained (e.g., calculated) by the velocity obtaining portion, is higher than an actual velocity of the object at that time. Since the calculated velocity of the driving device is controlled, under a feedback control, to a target velocity, the actual velocity of the object is lowered from the target velocity, in the second path portion.

In addition, in this driving apparatus, the stopper may be provided in a vicinity of at least one of opposite ends of the predetermined path and may engage, when the object is moved to the one end, the object and thereby stop the further movement of the object. The linear scale may be provided along the predetermined path, such that the second scale portion of the linear scale is nearer to the one end of the predetermined path than the first scale portion of the linear scale, so that when the object is moved to the one end, the object is moved from the first path portion into the second path portion. The first scale portion of the linear scale may be adjacent to the second scale portion thereof. The first predetermined distance may be smaller than each of the first predetermined pitch and a reference pitch as the reference value. However, the stopper may be a movable stopper which is provided in an intermediate portion of the predetermined path and which is selectively movable to an operative position where the stopper can engage and stop the object and to an inoperative position where the stopper cannot engage the object.

In addition, in this driving apparatus, the control device may further include a reference-position determining portion which detects at least one stop position where the further movement of the object is stopped by the at least one stopper, and which determines, based on the detected at least one stop position, at least one reference position of the object. The reference position may be an origin or a home position of the object (e.g., a carriage of a printer). The reference-position determining portion may include a stop-position detecting portion which detects the at least one stop position, based on at least one of the plurality of detection signals; and a determining portion which determines the at least one reference position of the object, based on the at least one stop position detected by the stop-position detecting portion.

According to a second aspect of the present invention, there is provided a driving apparatus, comprising a driving device which reciprocatively moves an object along a predetermined path; a linear encoder having a linear scale which is provided along the predetermined path and which includes at least one first scale portion having a plurality of first detectable portions provided at a predetermined pitch, and a detector which is moved, when the object is moved by the driving device, so as to sequentially detect the first detectable portions and sequentially output a plurality of first detection signals each of which indicates a detection of a corresponding one of the first detectable portions; a velocity calculating portion which calculates, each time a predetermined condition is met, a first velocity of the object, based on at least one of the first detection signals sequentially outputted by the detector; and a control portion which controls, based on the calculated first velocities of the object, the driving device to move the object along at least one first path portion of the predetermined path that corresponds to the at least one first scale portion; at least one stopper which is provided in a vicinity of at least one of opposite ends of the predetermined path, and on which the object impacts when the object is moved to the at least one end; an impaction detecting portion which detects that the object has impacted on the at least one stopper and a further movement of the object has been stopped by the at least one stopper; and a reference-position determining portion which detects, when the impaction detecting portion detects that the object has impacted on the at least one stopper, at least one stop position where the further movement of the object has been stopped by the at least one stopper, and which determines, based on the detected at least one stop position, at least one reference position of the object. The linear scale has an actually detectable portion which corresponds to a reciprocative-movement portion of the predetermined path where the object can be reciprocatively moved by the driving device, and which includes, in addition to the at least one first scale portion, at least one second scale portion that is nearer to the at least one end of the predetermined path than the at least one first scale portion and that has a plurality of second detectable portions including at least one pair of adjacent second detectable portions which are distant from each other by a predetermined distance smaller than the predetermined pitch, and the detector sequentially detects the second detectable portions and sequentially outputs a plurality of second detection signals each of which indicates a detection of a corresponding one of the second detectable portions. The velocity calculating portion uses the predetermined pitch as a common pitch which is common to an entirety of the actually detectable portion of the linear scale, such that the velocity calculating portion calculates, based on the common pitch, the first velocity of the object based on the at least one of the first detection signals, and calculates, based on the common pitch, a second velocity of the object based on at least one of the second detection signals. The linear scale may have two first scale portions having different pitches each of which is greater than the predetermined distance and one of which is used as the common pitch. In this case, the second scale portion may be the nearest to the one end of the predetermined path, and one of the two first scale portions may be adjacent to the second scale portion. In the case where the linear scale has, in addition to the second scale portion, only one first scale portion, the one first scale portion is adjacent to the second scale portion nearer to the one end of the predetermined path than the first scale portion.

This driving apparatus need not modify a software arrangement such that when the reference position of the object is detected, the object is moved at a lowed velocity from a start of the operation, or need not modify a hardware construction, e.g., employ a sensor, so as to detect that the object has reached a position before the reference position. Thus, the present driving apparatus can determine the reference position of the object, without needing to complicate the construction of the driving apparatus or lower the operation efficiency thereof, while the impact force produced when the object impacts on the stopper is reduced.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described preferred embodiments of the present invention by reference to the drawings.

First Embodiment

Figure 1:
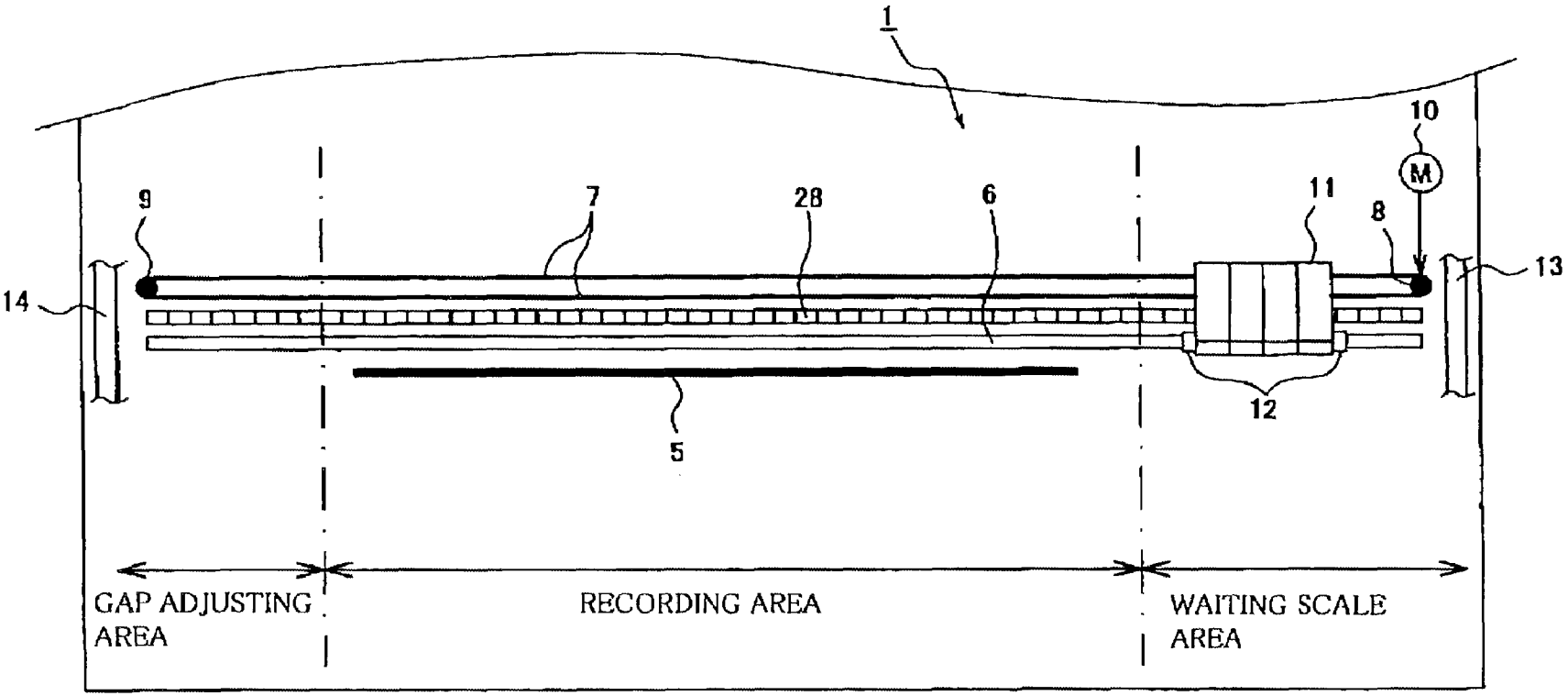
FIG. 1 is a schematic view of a carriage driving apparatus, employed by an ink-jet printer, to which the present invention is applied.

FIG. 1 schematically shows a construction of a carriage driving apparatus 1, employed by an ink-jet printer (hereinafter, simply referred to as the printer), to which the present invention is applied.

As shown in FIG. 1, the carriage driving apparatus 1 employs a guide bar 6 extending in a widthwise direction of a recording sheet 5 that is fed by a feeding roller, not shown. The guide bar 6 supports a carriage 12 on which a head unit 11 is mounted. The head unit 11 is supplied with four sorts of inks from four ink cartridges, not shown, and includes a recording head, not shown, that has four groups of nozzles for ejecting droplets of the four inks toward the recording sheet 5 and thereby recording a full-color image on the same 5.

The carriage 12 is connected to an endless belt 7 extending along the guide bar 6, and the endless belt 7 is wound on a drive pulley 8 connected to a carriage motor 10 provided in the vicinity of one of opposite ends of the guide bar 6 and an idle pulley 9 provided in the vicinity of the other end of the same 6.

Thus, the carriage 12 is reciprocatively driven or moved along the guide bar 6, in the widthwise direction of the recording sheet 5, owing to a driving force transmitted from the carriage motor 10 via the endless belt 7. Thus, the carriage 12 is moved relative to a support member of the carriage driving apparatus 1. The support member may be a housing or a main frame of the printer that includes a right side frame 13 and a left side frame 14.

In the vicinity of the guide bar 6, a linear scale 28 having a plurality of encoder slits 29, 30 is provided along the guide bar 6, i.e., along a predetermined movement path along which the carriage 12 is reciprocated. A linear encoder i.e., a carriage-driving-related encoder) 20 includes, in addition to the linear scale 28, a detecting portion 21 (FIG. 3) that is supported by a lower portion of the carriage 12 and is moved with the same 12.

The detecting portion 21 includes a light emitting portion 22 and a light receiving portion 23 that are provided on either side of the linear scale 28. The linear encoder 20 detects an amount of movement of the carriage 12.

Figure 3:
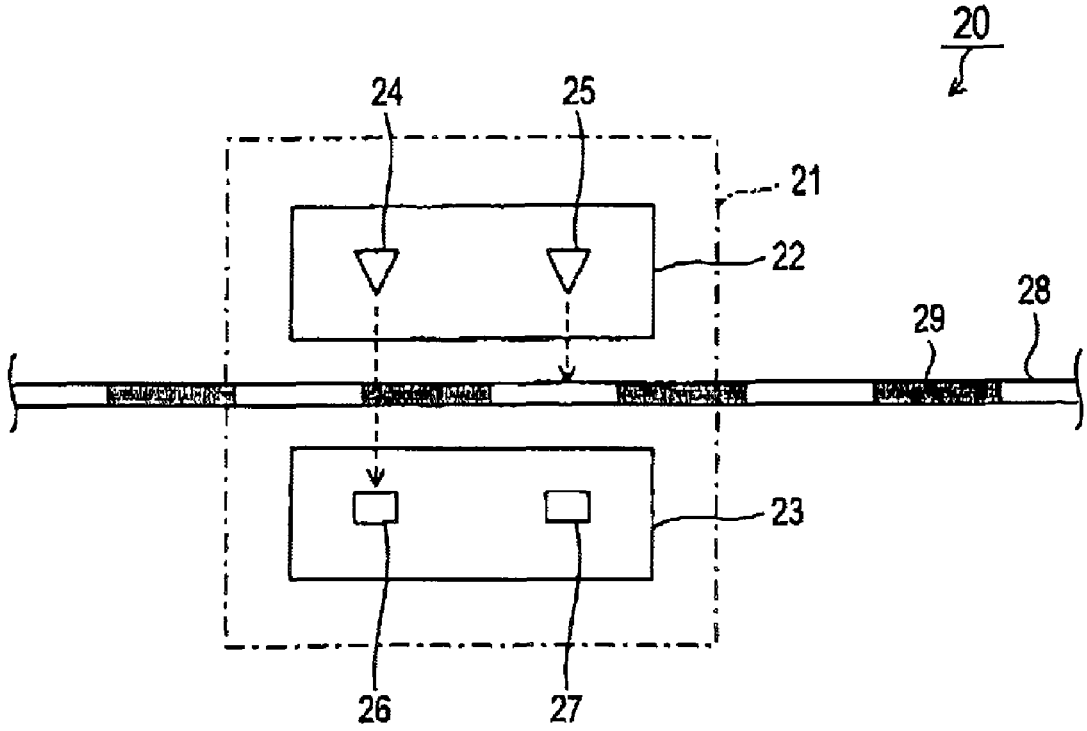
FIG. 3 is a schematic front view of a linear encoder of the carriage driving apparatus.

More specifically described, as shown in FIG. 3, the linear encoder 20 includes the linear scale 28 having the encoder slits (i.e., openings) 29, 30, and the detecting portion 21. The encoder slits 29, 30 correspond to first and second detectable portions; and the detecting portion 21 corresponds to a detector that detects each of the detectable portions. The linear scale 28 is provided between the light emitting portion 22 and the light receiving portion 23 of the detecting portion 21. The light emitting portion 22 includes two light emitting elements, i.e., an A-phase light emitting element 24 and a B-phase light emitting element 25; and the light receiving portion 23 includes two light receiving elements, i.e., an A-phase light receiving element 26 and a B-phase light receiving element 27. A light emitted by the A-phase light emitting element 24 is received by the A-phase light receiving element 26; and a light emitted by the B-phase light emitting element 25 is received by the B-phase light receiving element 27.

Since the detecting portion 21 is supported by the lower portion of the carnage 12, the detecting portion 21 is moved with the carriage 12 relative to the linear scale 28 fixed to the main frame of the printer. Therefore, each of the two light receiving elements 26, 27 may, or may not, receive the light emitted by a corresponding one of the two light emitting elements 24, 25, depending upon a positional relationship between the detecting portion 21 and the linear scale 28. In a state shown in FIG. 3, the A-phase light receiving element 26 receives the light emitted by the A-phase light emitting element 24 through one of the encoder slits 29, 30, but the B-phase light receiving element 27 does not receive the light emitted by the B-phase light emitting element 25 because the light is reflected by the linear scale 28. FIG. 3 is a front elevation view of the linear scale 28; and FIG. 5 (described in detail, later) is a plan view of the same 28 as seen in a direction from the light emitting portion 22 toward the light receiving portion 23.

Figure 4:
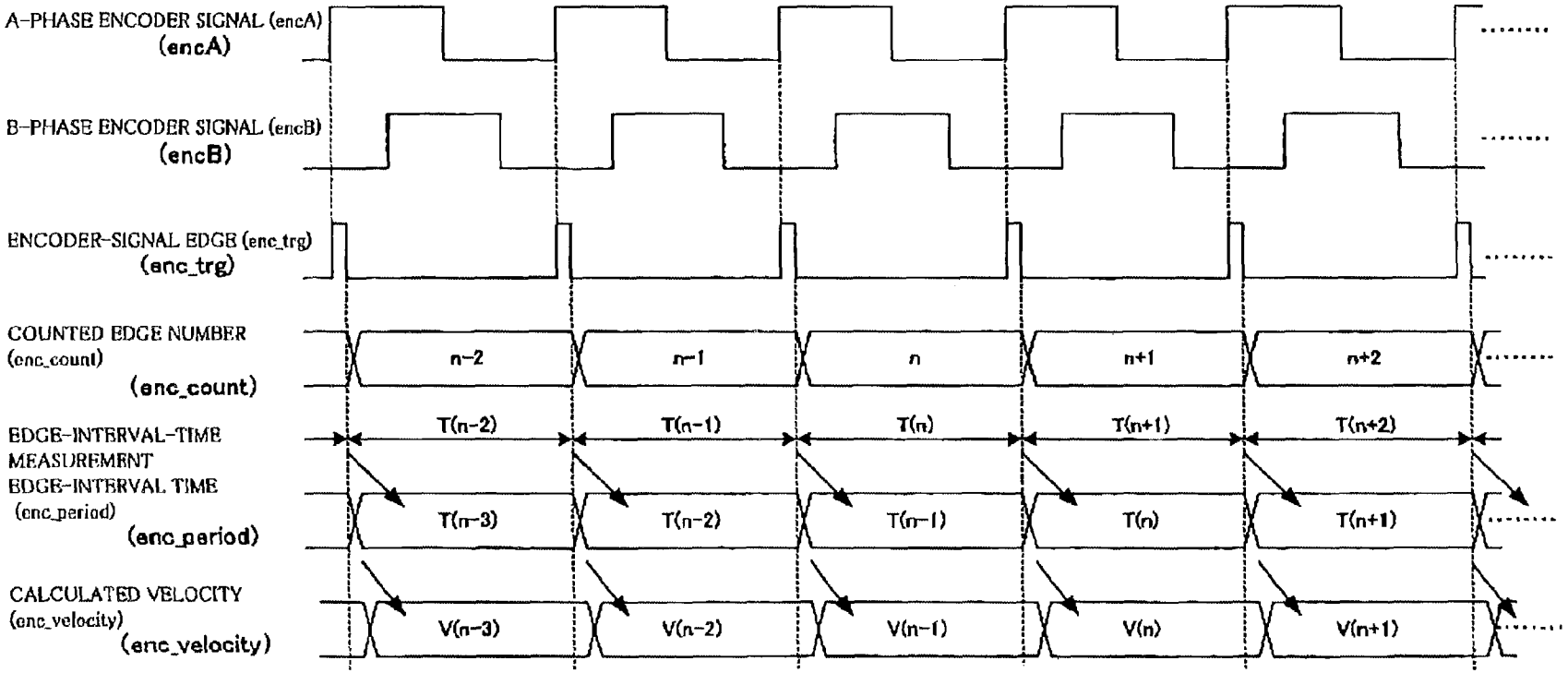
FIG. 4 is a graph representing two encoder signals and operations for processing the encoder signals.

As shown in FIG. 4, the detecting portion 21 outputs two sorts of pulse signals that are offset from each other by a predetermined phase (in the present embodiment; one fourth of a period of each of the pulse signals). More specifically described, the A-phase light receiving element 26 outputs an A-phase encoder signal, encA, representing the detected light; and the B-phase light receiving element 27 outputs a B-phase encoder signal, encB, representing the detected light. When the carriage 12 is moved in a direction from its home position, i.e., a right-hand end of the movement path toward the idle pulley 9, the A-phase encoder signal, encA, precedes the B-phase encoder signal, encB, by the predetermined phase; and when the carriage 12 is moved in the opposite direction from the idle pulley 9 toward the home position, the B-phase encoder signal, encB, precedes the A-phase encoder signal, encA, by the predetermined phase.

Figure 5:
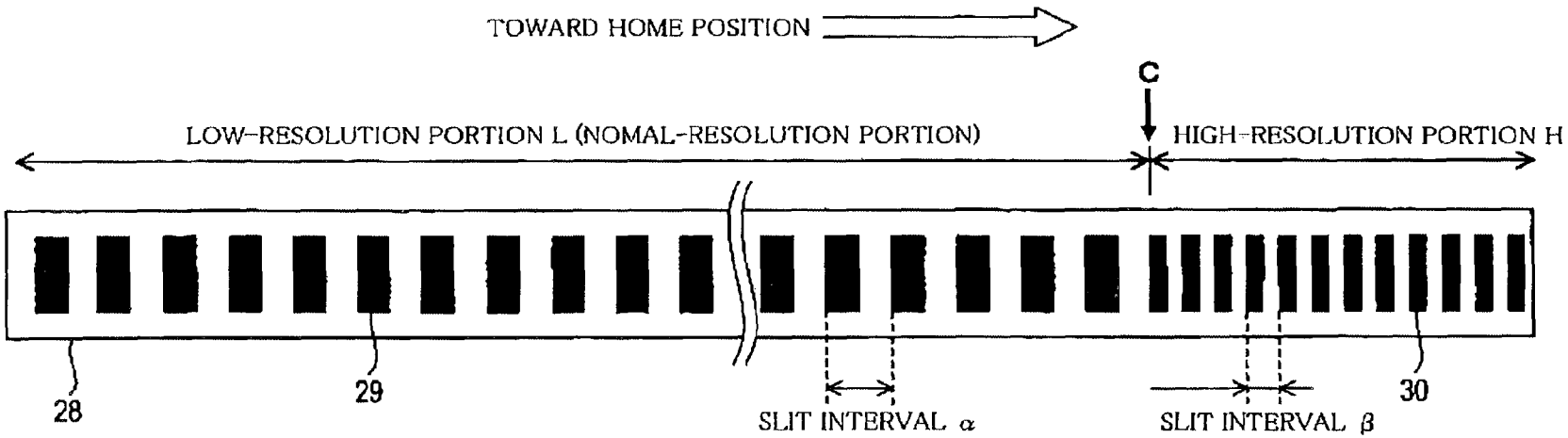
FIG. 5 is a plan view of a linear scale employed by the linear encoder.

In the present embodiment, the linear scale 28 of the linear encoder 20 has a characteristic feature, FIG. 5 shows the linear scale 28. As shown in the figure, the linear scale 28 includes, unlike a conventionally known, common linear scale having a plurality of encoder slits formed at regular intervals of distance over an entire length thereof, a low-resolution (or, normal-resolution) portion, L, having the encoder slits 29 formed at large regular intervals, $\alpha$, of distance, and a high-resolution portion, H, having encoder slits 30 formed at small regular intervals, $\beta$ ($<\alpha$), of distance.

The interval $\alpha$ is constant in the low-resolution portion L; and the interval $\beta$ is constant in the high-resolution portion H. The high-resolution portion H is nearer to the home position, i.e., an origin of the carriage driving apparatus 1 than the low-resolution portion L.

That is, the linear scale 28 is constituted by the high-resolution portion H located next to the home position, and the low-resolution portion L as the remaining portion of the scale 28. Thus, when an origin detecting operation (i.e., an encoder calibrating operation) is carried out, a position of the carriage 12 is changed from the low-resolution portion L to the high-resolution portion H via a resolution-change point, C, where the low resolution $\alpha$ changes to the high resolution $\beta$, and is further changed in the high-resolution portion H toward the home position, and finally the carriage 12 is impacted on the right side frame 13 of the printer.

In the following description, the position of the carriage 12 relative to the linear scale 28 or the main frame (13, 14) of the printer is defined as a position of the light emitted by the A-phase light emitting element 24 of the detecting portion 21 supported by the carriage 12, relative to the linear scale 28. For example, that the carriage 12 has passed through the resolution-change point C means that the light emitted by the A-phase light emitting element 24 has passed through the point C.

FIG. 1 shows a gap adjusting area in which a gap adjusting device, not shown, is operated to adjust a gap present between the nozzles of the recording head and the recording sheet 5.

The printer has the left side frame 14 (FIG. 1) in addition to the right side frame 13. In the present embodiment, the origin detecting operation is carried out by causing the carriage 12 to impact on the right frame 13 and determining, as the origin, a position where the carriage 12 has impacted on the right side frame 13. However, the origin detecting operation may be carried out by causing the carriage 12 to impact on the left side frame 14.

Various sorts of carriage driving and controlling operations, including the origin detecting operation, are carried out by a carriage-driving controlling device that is incorporated in the printer.

Figure 2:
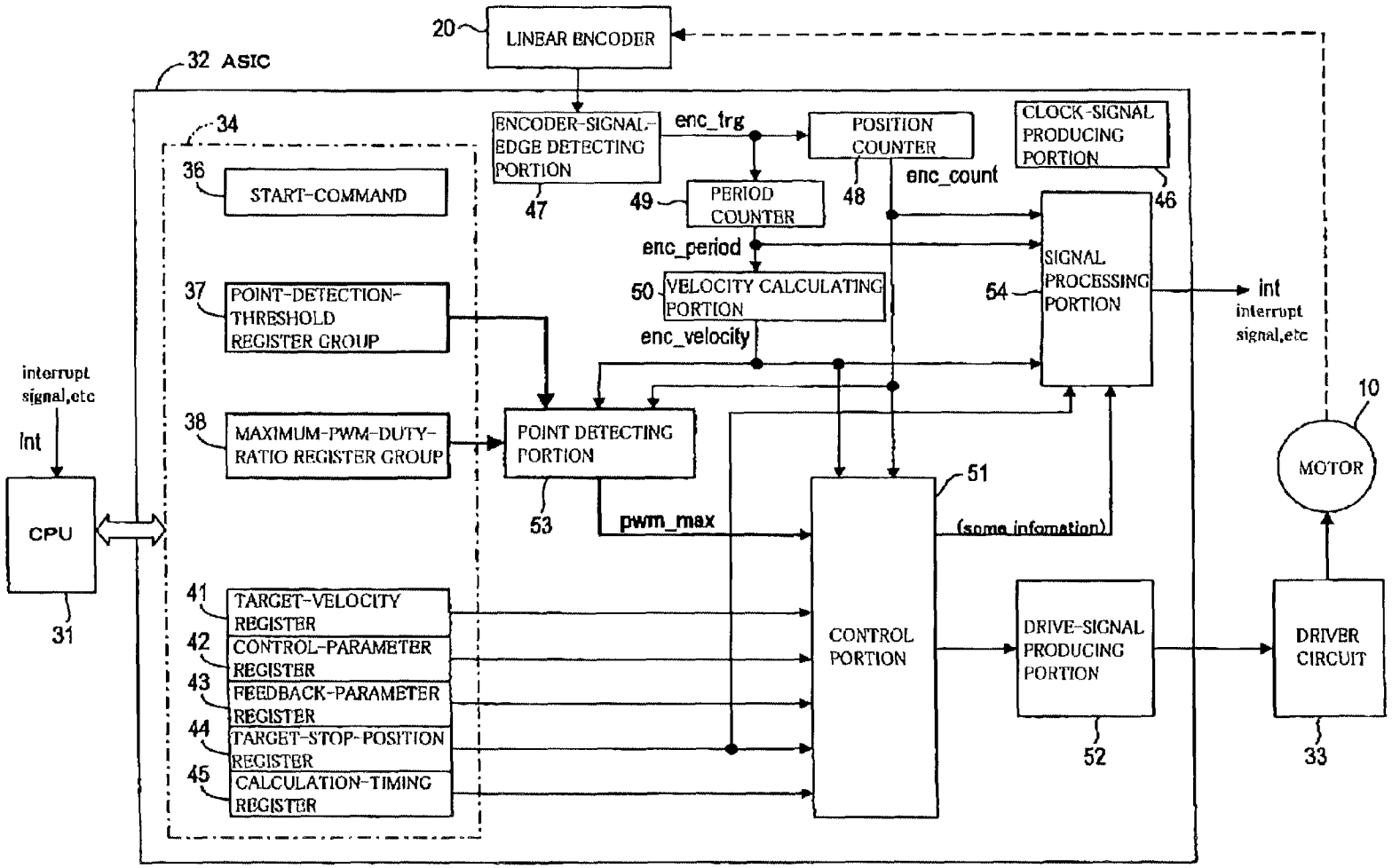
FIG. 2 is a diagrammatic view of a control device (i.e., ASIC, application specific integrated circuit) of the carriage driving apparatus.

As shown in FIG. 2, the carriage-driving controlling device is for driving, based on a command supplied from a CPU (central processing unit) 31 that controls the printer as a whole, the carriage motor 10 as an actuator of the carriage 12. The carriage-driving device includes an ASIC (application specific integrated circuit) 32 that produces a PWM (pulse width modulation) signal to control a rotation velocity and a rotation direction of the motor 10; and a driver circuit 33 that drives the motor 10 based on the PWM signal produced by the ASIC 32.

The driver circuit 33 is constituted by a well-known H bridge (Wheatstone bridge) including four switching elements (e.g., FETs, field effect transistors) and flywheel diodes that are connected in parallel to the switching elements, respectively. Supplying of an electric power to the motor 10 can be controlled by turning the switching elements ON and OFF according to the drive signal (i.e., the PWM signal) received from the ASIC 32.

The ASIC 32 includes a group of operation-mode registers 34 that store various parameters needed to drive and control the motor 10

The operation-mode register group 34 includes a start-command register 36 that stores a start command to start the motor 10; a group of point-detection-parameter registers 37 that store various parameters needed to judge whether the carriage 12 has passed through the resolution change point C when the carriage 12 is moved toward the origin (i.e., the right side frame 13) during the origin detecting operation, and additionally store various parameters needed to judge whether the carriage 12 has impacted on the right side frame 13 after the carriage 12 has passed through the resolution change point C; a group of maximum-PWM-duty-ratio registers 38 that store different upper limits of the duty ratio of the PWM signal (i.e., different maximum PWM duty ratios) used to drive or move the motor 10; a target-velocity register 41 that stores a target velocity at which the carriage 12 is to be driven or moved; a control-parameter register 42 that stores various control parameters; a feedback-parameter register 43 that store various feedback parameters, such as gains or constants, needed for a feedback control of the motor 10; a target-stop-position register 44 that stores a target stop position at which the carriage 12 is to be stopped; and a calculation-timing register 45 that stores calculation timings at each of which a motor operating amount (i.e., a motor driving force or a PWM duty ratio) is calculated. All the parameters stored by the operation-mode register group 34 are written by the CPU 31.

In addition to the above-described operation-mode register group 34, the ASIC 32 includes a clock-signal producing portion 46 that produces a clock signal, CK, whose period is sufficiently shorter than that of the encoder signals encA, encB produced by the linear encoder 20, and supplies the clock signal CK to each element of the ASIC 32; an encoder-signal-edge detecting portion 47, a position counter 48, a period counter 49, and a velocity calculating portion 50 that detect edges of the encoder signals encA encB produced by the linear encoder 20 and detects or calculates a position, and a movement velocity, of the carriage 12; a control portion 51 that calculates, based on the detection results obtained by those elements 47, 48, 49, 50 and the various parameters stored by the operation-mode register group 34, a motor operating amount (i.e., a PWM duty ratio); a drive-signal producing portion 52 that produces, as a drive signal to drive the motor 10 in a duty-cycle manner, a PWM signal corresponding to the motor operating amount calculated by the control portion 51, and supplies the PWM signal to the driver circuit 33; a point detecting portion 53 that is supplied with the movement velocity, enc_velocity, calculated by the velocity calculating portion 50 and the various parameters stored by the point-detection-parameter register group 37 and the maximum-PWM-duty-ratio register group 38, judges whether the carriage 12 has passed through the resolution change point C when the carriage 12 is moved toward the origin during the origin detecting operation, and whether the carriage 12 has impacted on the right side frame 13 after the carriage 12 has passed through the resolution change point C, and selects and outputs maximum PWM duty ratios, pwm_max, corresponding to the judgment results; and a signal processing portion 54 that processes various signals produced in the ASIC 32 and outputs the thus processed signals to the CPU 31.

The encoder-signal-edge detecting portion 47 is supplied with the encoder signals, encA, encB, shown in FIG. 4, and detects an edge of the A-phase encoder signal, encA, that indicates a start/end of each period thereof. In the present embodiment, the edge detecting portion 47 detects an edge of the signal encA when the B-phase encoder signal, encB, takes a low level. Based on the detected edges of the encoder signals encA, encB, the edge detecting portion 47 detects a direction in which the motor 10 is rotated, i.e., the carriage 12 is moved. The edge detecting portion 47 produces an edge detection signal enc_trg, indicating detection of an edge, to each of the position counter 48 and the period counter 49.

The position counter 48 increases or decreases, depending upon the direction of rotation of the motor 10 (i.e., the direction of movement of the carriage 12), detected by the edge detecting portion 47, a counted number, enc_count, based on the edge detection signals, enc_trg, produced by the edge detecting portion 47. The counted number indicates a current position of the carriage 12 as measured from the origin (i.e., the home position). The counted number, enc_count, is supplied to each of the control portion 51, the point detecting portion 53, and the signal processing portion 54.

The period counter 49 is reset to zero, each time it receives an edge detection signal, enc_trg, from the edge detecting portion 47, and measures an interval time after the reception of the edge detection signal, enc_trg, by counting a number of the clock signals CK. The period counter 49 supplies an edge interval time, enc_period, indicating the measured time, to each of the velocity calculating portion 50 and the signal processing portion 54.

The velocity calculating portion 50 calculates, in synchronism with the reception of each edge detection signal, enc trg, a velocity of movement of the carriage 12, i.e., a detected velocity, enc_velocity (=reso/enc_period), based on a velocity-calculation resolution, reso, of the linear encoder 20 (or the linear scale 28) and a hold value, $C_{n-1}$, indicating the edge interval time, enc_period, measured by the period counter 49 during the preceding period of the A-phase encoder signal encA.

As shown in FIG. 5, the linear scale 28 has the low-resolution scale portion L whose encoder slits 29 have the slit interval α, and the high-resolution scale portion H whose encoder slits 30 have the slit interval β smaller than the interval α. However, as the velocity-calculation resolution, reso, used by the velocity calculating portion 50 in calculating the velocity of movement of the carriage 12, the slit interval a of the encoder slits 29 of the low-resolution scale portion L is used irrespective of where the carriage 12 is currently positioned relative the linear scale 28. A length of the high-resolution scale portion H may be smaller than 30%, more preferably 20%, and most preferably 10%, of the sum of the respective lengths of the low-resolution scale portion L and the high-resolution scale portion H, i.e., an entire length of a detectable range of the linear scale 28.

That is, the velocity calculating portion 50 calculates all the velocity values of the carriage 12 as if the slit interval α of the low-resolution scale portion L were the common slit interval of all the encoder slits 29, 30 of the linear scale 28. Therefore, even if the carriage 12 may be moved from the low-resolution scale portion L into the high-resolution scale portion H via the resolution-change point C, not the slit interval β of the high-resolution scale portion H but the slit interval a of the low-resolution scale portion L is used as the velocity-calculation resolution, reso. Thus, when the carriage 12 is moved in the high-resolution scale portion H, each detected (or "apparent") velocity, enc_velocity, of the carriage 12 is calculated by the velocity calculating portion 50 to be higher than a corresponding "actual" velocity of the carriage 12.

Figure 8:
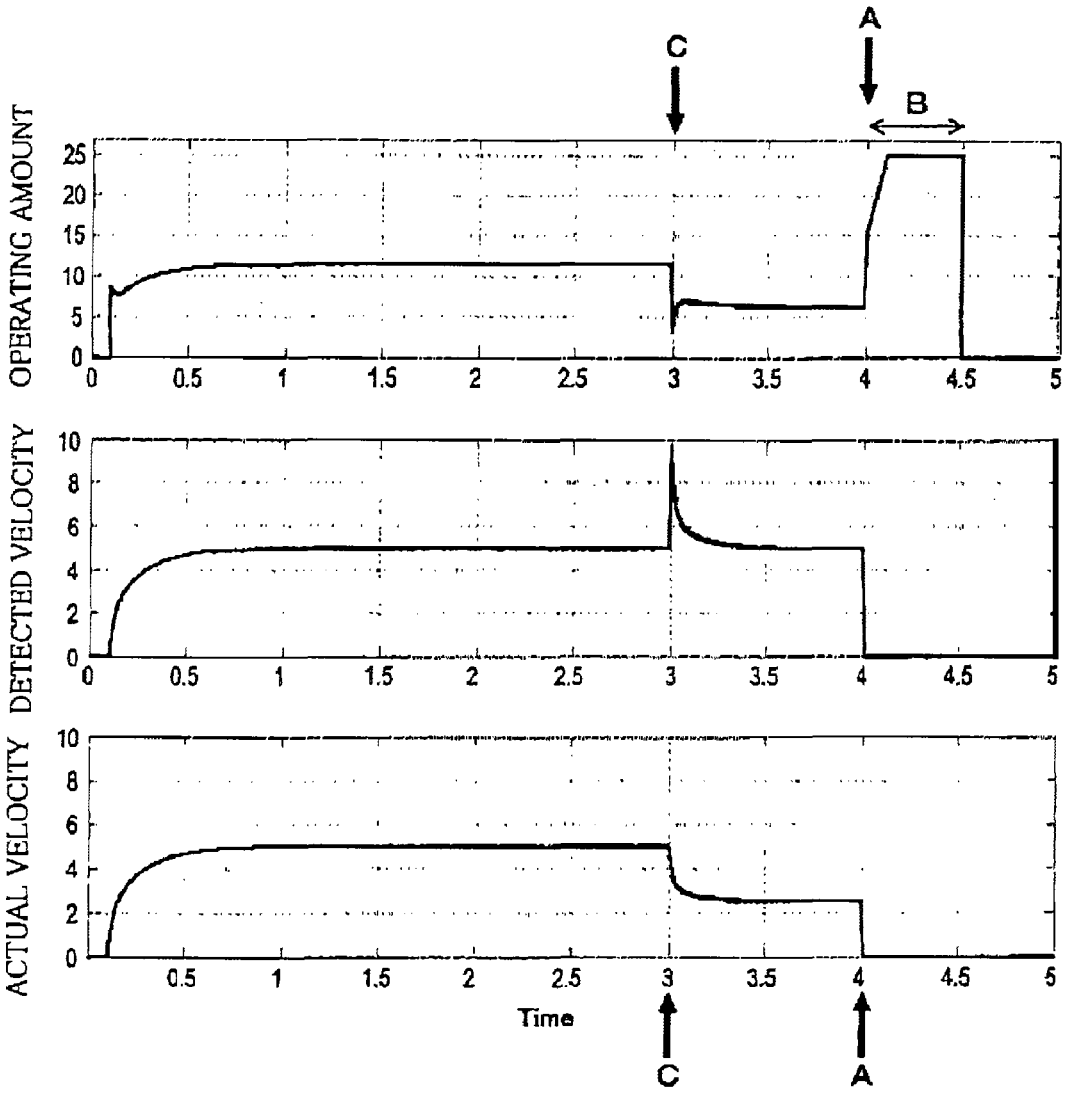
FIG. 8 is a graph representing respective time-wise changes of an actual velocity of a carriage of the printer, a detected (i.e., calculated) velocity of the carriage, detected (i.e., calculated) by a velocity calculating portion of the control device, and a motor operating amount, each in an origin (or home-position) detecting operation.

The reason why, when the carnage 12 is moved in the high-resolution scale portion H, a detected velocity, enc_velocity, is calculated to be higher than an actual velocity is explained in more detail by reference to FIG. 8. FIG. 8 shows actual velocities of the carriage 12 during the origin detecting operation; detected (apparent) velocities, enc_velocity, of the carriage 12 calculated by the velocity calculating portion 50 during the origin detecting operation; and motor operating amounts (i.e., duty ratios of the PWM signal inputted to the driver circuit 33) during the origin detecting operation. During the origin detecting operation, the carriage 12 is moved from an appropriate position in the low-resolution scale portion L toward the origin while the carriage 12 (or the motor 10) is feedback controlled using the target velocity stored by the target-velocity register 41.

As shown in FIG. 8, at about one second after the commencement of the origin detecting operation, the carriage 12 is placed in a steady (i.e., constant-velocity) state. Then, at about three seconds after, the carriage 12 passes through the resolution-change point C where the large slit interval (low resolution) α is changed to the small slit interval (high resolution) β smaller than the slit interval α. Consequently the detected (apparent) velocities, enc_velocity, abruptly increase. FIG. 8 shows an exemplary case where a ratio of the high resolution β to the low resolution α is 2. Therefore, at the resolution-change point C, the detected velocities, enc_velocity, increase by about 100%. Thus, the control portion 51 performs a feedback control to lower the detected velocity, enc_velocity to the target velocity. Thus, the detected velocities, enc_velocity, are gradually lowered to the target velocity. The small slit interval β may be smaller than the large slit interval α, by not less than 20%, more preferably, not less than 30%, and most preferably, not less than 40%.

However, it is the detected (apparent) velocity, enc velocity, that is lowered to the target velocity. Therefore, the actual velocities of the carriage 12 are lowered from the target velocity to a value corresponding to the ratio of the high resolution β to the low resolution α. For example, in the case where the actual velocities of the carriage 12 in the low-resolution scale portion L are about 5 inch/sec. substantially equal to the detected velocities, enc_velocity, the actual velocities of the carriage 12 in the high-resolution scale portion H are about 2.5 inch/sec., i.e., about half the actual velocities in the low-resolution scale portion L.

Then, at four seconds after, the carriage 12 impacts on the right side frame 13 and a further movement thereof is stopped. Thus, the detected velocity, enc_velocity, and the actual velocity of the carriage 12 are lowered to zero. On the other hand, the control portion 51 performs a feedback control to change the detected velocity, enc_velocity, to the target velocity. Consequently the motor operating amount to move the carriage 12 stopped is abruptly increased. However, the motor operating amount is not limitlessly increased. That is, the motor operating amount does not exceed a current upper limit, i.e., a current maximum PWM duty ratio, pwm_max, that is supplied from the point detecting portion 53 to the control portion 51.

In the example shown in FIG. 8, if a state in which the motor operating amount is maintained at the upper limit after the motor operating amount is abruptly increased, lasts for a predetermined time, B (e.g., 0.5 second), then it is judged that the carriage 12 has been impacted on, and stopped by, the side frame 13 at an impact point, A, and the motor operating amount is lowered to zero. Thus, the impact point A is detected as the origin of the carriage 12.

However, in the present embodiment, the impaction of the carriage 12 on the side frame 13 at the impact point A is not detected in the above-explained manner in which the change of the motor operating amount is utilized, but in a more quick manner, described later, in which the change of the detected velocity, enc_velocity, is utilized. However, the present embodiment may be modified such that the impaction of the carriage 12 on the side frame 13 is detected in the above-explained manner.

Back to FIG. 2, the control portion 51 iteratively calculates motor operating amounts from a time when the CPU 31 sets, in the start-command register 36, a start command to start a motor-driving controlling operation, to a time when it is judged that the carriage has been stopped at a target stop position stored by the target-stop-position register 44. The motor-driving controlling operation encompasses the origin detecting operation.

More specifically described, if the start command is set in the start-command register 36, the control portion 51 determines, in synchronism with the reception of each of a plurality of edge detection signals, enc_trg, a corresponding one of a plurality of motor operating amounts to operate the motor 10 and thereby move the carriage 12 from its current stop position, according to a predetermined velocity-change pattern. Subsequently, the control portion 51 calculates, at each of the periodic calculation timings stored by the calculation-timing register 45, a motor operating amount (i.e., a PWM duty ratio) for a feedback control of the detected velocity, enc_velocity, to the target velocity, based on the detected velocity, enc_velocity, calculated by the velocity calculating portion 50, the target velocity stored by the target-velocity register 41, the control parameters stored by the control-parameter register 42, and the feedback parameters stored by the feedback-parameter register 43.

The maximum-PWM-duty-ratio register group 38 stores a plurality of different maximum PWM duty ratios, as will be described later, and one of those maximum PWM duty ratios is selected by the point detecting portion 53 and is inputted by the same 53 into the control portion 51. The maximum PWM duty ratio thus inputted to the control portion 51 is used by the same 51 as the upper limit under which the motor operating amounts (PWM duty ratios) are calculated by the same 51.

Next, respective internal arrangements of the point-detection-parameter register group 37, the maximum-PWM-duty-ratio register group 38, and the point detecting portion 53 of the ASIC 32 will be described by reference to FIG. 6.

Figure 6:
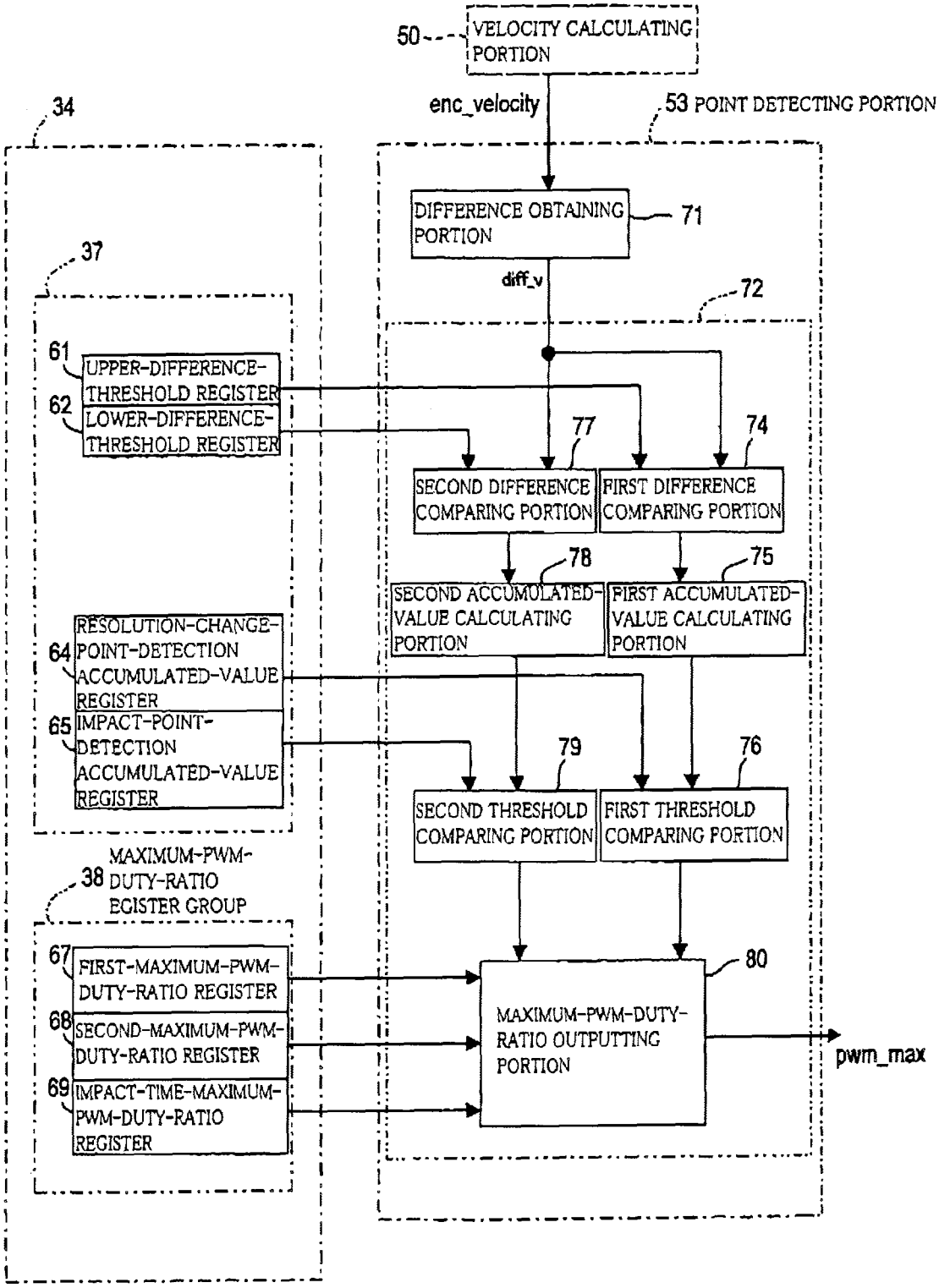
FIG. 6 is a diagrammatic view of respective internal arrangements of a point-detection-threshold register group, a maximum-PWM-duty-ratio register group, and a point detecting portion of the control device (ASIC)

As shown in FIG. 6, the point-detection-threshold register group 37 of the operation-mode register group 34 includes an upper-difference-threshold register 61 that stores an upper threshold of a difference of two detected velocities, enc velocity, (i.e., a velocity-increase threshold) that is used in an initial stage in a first judging operation to judge whether the carriage 12 has passed through the resolution-change point C; a lower-difference-threshold register 62 that stores a lower threshold of a difference of two detected velocities, enc_velocity, (i.e., a velocity-decrease threshold) that is used in an initial stage in a second judging operation to judge whether the carriage 12 has impacted on the side frame 13 at the impact point A; a change-point-detection accumulated-value-threshold register 64 that stores a threshold of an accumulated value used to judge finally whether the carriage 12 has passed through the resolution-change point C; and an impact-point-detection accumulated-value-threshold register 65 that stores a threshold of an accumulated value used to judge finally whether the carnage 12 has been impacted on the side frame 13 at the impact point A.

The maximum-PWM-duty-ratio register group 38 includes a first maximum-PWM-duty-ratio register 67 that stores a first maximum PWM duty ratio as a maximum PWM duty ratio used when the carriage 12 is moved in the low-resolution scale portion L having the large slit interval a; a second maximum-PWM-duty-ratio register 68 that stores a second maximum PWM duty ratio as a maximum PWM duty ratio used when the carriage 12 is moved in the high-resolution scale portion H having the small slit interval β; and an impact-time-maximum-PWM-duty-ratio register 68 that stores an impact-time maximum PWM duty ratio as a maximum PWM duty ratio used after the impaction of the carriage 12 on the side frame 13 has been detected. The second maximum PWM duty ratio is smaller than the first maximum PWM duty ratio.

The point detecting portion 53 includes a difference obtaining portion 71 that obtains and outputs, at a predetermined period, a difference value, dif_v, as an amount of change of the detected velocities, enc_velocity, calculated by the velocity calculating portion 50; and a point detector 72 that detects, based on the difference values, diff_v, obtained by the difference obtaining portion 71, the passing of the carriage 12 through the resolution-change point C and the impacting of the carriage 12 on the side frame 13.

Figure 7:
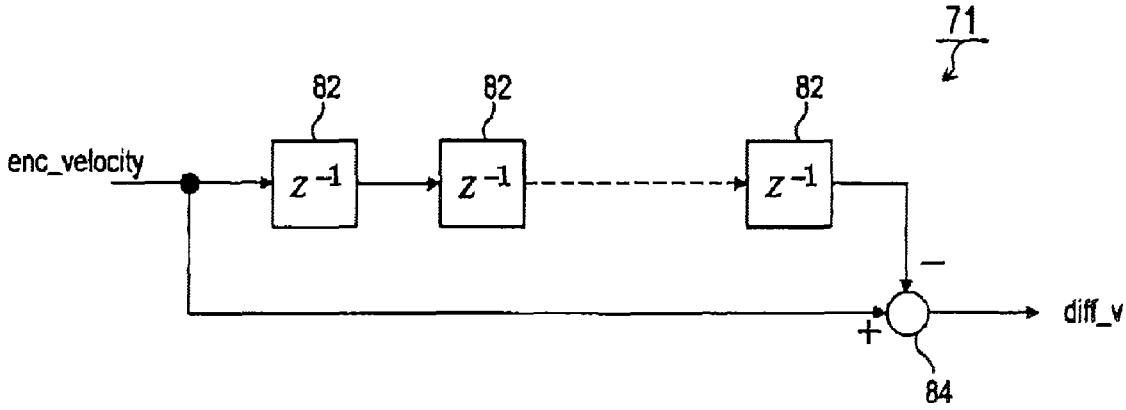
FIG. 7 is a schematic view of a difference obtaining portion of the point detecting portion.

As shown in FIG. 7, the difference obtaining portion 71 includes a time delaying portion including a plurality of time delay relays 82 that are connected in series to each other; and a subtracter 84 that obtains, as the difference value, diff_v, a difference of the detected velocity, enc_velocity, calculated by the velocity calculating portion 50 and an output of the most downstream time delay relay 82 of the time delaying portion. That is, the difference obtaining portion 71 obtains and outputs, as the difference value, diff_v, a difference of the current detected velocity, enc_velocity, and the prior detected velocity, enc_velocity, prior to the current one by a delayed time corresponding to the total number of the time delay relays 82.

Figure 9:
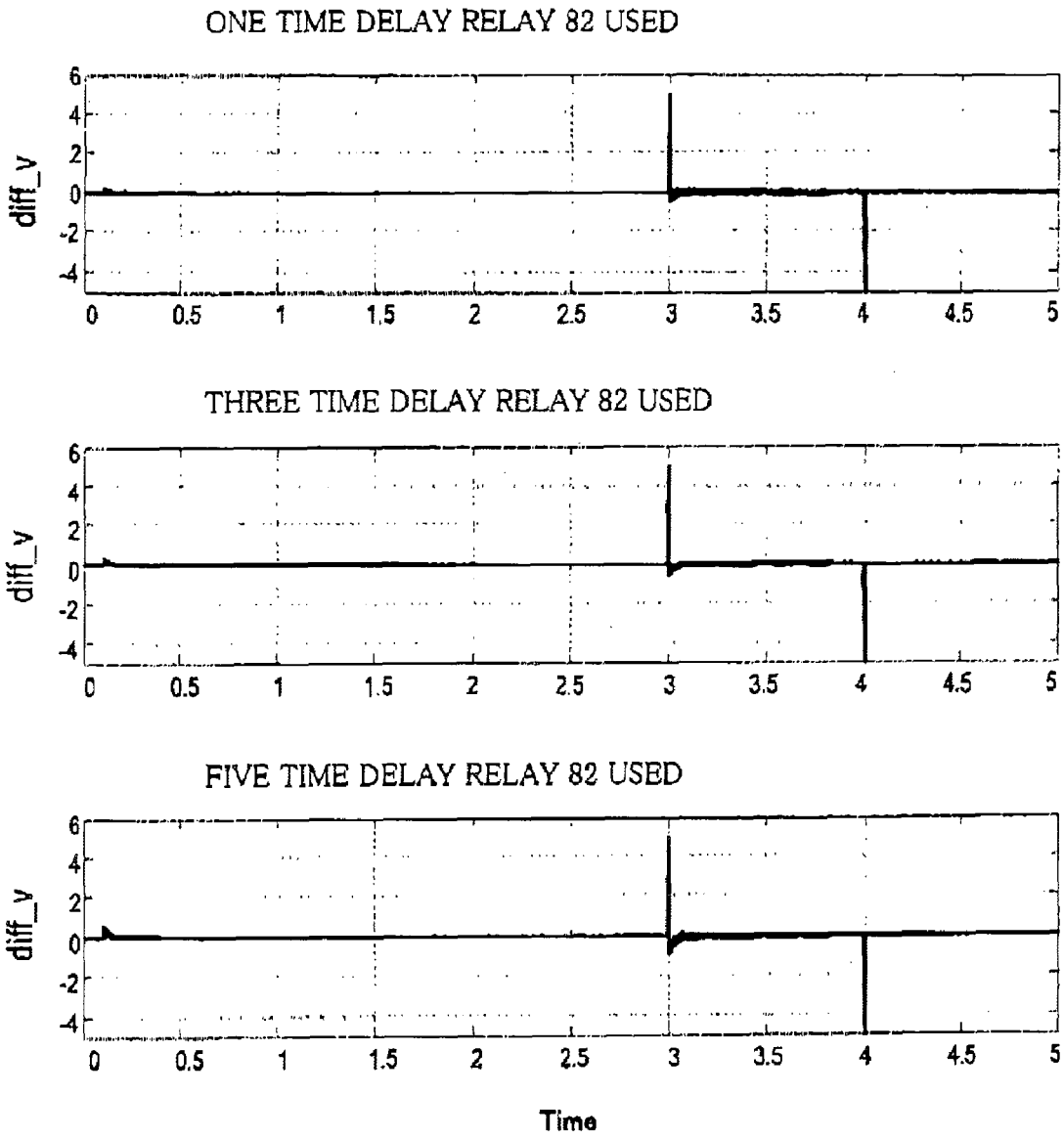
FIG. 9 is a graph representing respective time-wise changes of respective detected-velocity change amounts, diff_v, that are outputted by different difference obtaining portions in an origin detecting operation.

FIG. 9 shows three examples of a time-wise change of the difference values, diff_v outputted by the difference obtaining portion 71 when the carriage 12 is moved, using the common target velocity, from the predetermined position in the low-resolution scale portion L to the impact point A where the carriage 12 impacts on the frame 13. The first example is a time-wise change of the difference values, diff_v, in the case where the difference obtaining portion 71 includes a single time delay relay 82; the second example is a time-wise change of the difference values, diff_v, in the case where the difference obtaining portion 71 includes three time delay relays 82; and the third example is a time-wise change of the difference values, diff v, in the case where the difference obtaining portion 71 includes five time delay relays 82.

As shown in FIG. 9, while the carriage 12 is moved in the low-resolution scale portion L, the detected velocities, enc_velocity, are substantially constant, i.e., do not substantially change, so that the difference values, diff_v, outputted by the difference obtaining portion 71 are substantially zero. When the carriage 12 passes through the resolution-change point C at about three seconds after, the resolution changes from the low value α to the high value β, so that the detected velocities, enc_velocity; abruptly increase for the reason described above in connection with FIG. 8. Thus, the difference obtaining portion 71 outputs difference values, dif_v, indicating the change (i.e., abrupt increase) of the detected velocities, enc_velocity, that is, outputs large difference values, diff_v, each having a positive sign.

Subsequently, while the carriage 12 is moved in the high-resolution scale portion H, toward the side frame 13, the detected velocities, enc_velocity, are substantially constant, i.e., do not substantially change, so that the difference values, diff_v, outputted by the difference obtaining portion 71 are substantially zero. When the carriage 12 impacts on the frame 13 at about four seconds after, the carriage 12 is forcedly stopped by the same 13, so that the detected velocities, enc_velocity, abruptly decrease. Thus, the difference obtaining portion 71 outputs difference values, diff_v, indicating the change (i.e. abrupt decrease) of the detected velocities, enc_velocity, that is, outputs large difference values, diff_v, each having a negative sign. After the impacting of the carriage 12 on the side frame 13, since the carriage 12 is kept stopped, the detected velocities, enc_velocity, are substantially constant again and accordingly the difference values, diff_v outputted by the difference obtaining portion 71 are substantially zero.

Figure 10:
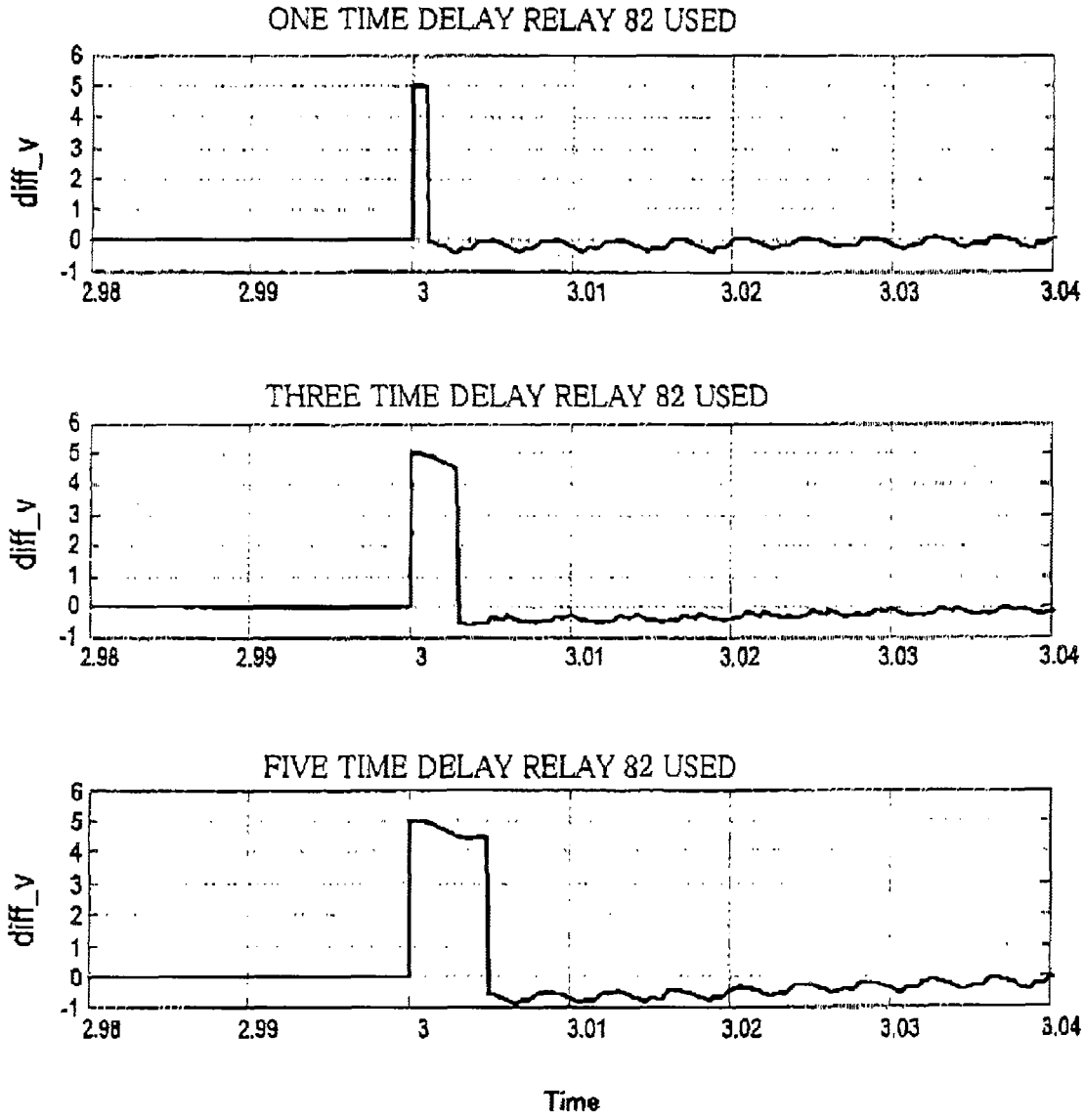
FIG. 10 is a graph representing only respective portions of the three time-wise changes, shown in FIG. 9, that correspond to a timing when the carriage passes through a resolution-change point, C, where a low resolution changes to a high resolution.
Figure 11:
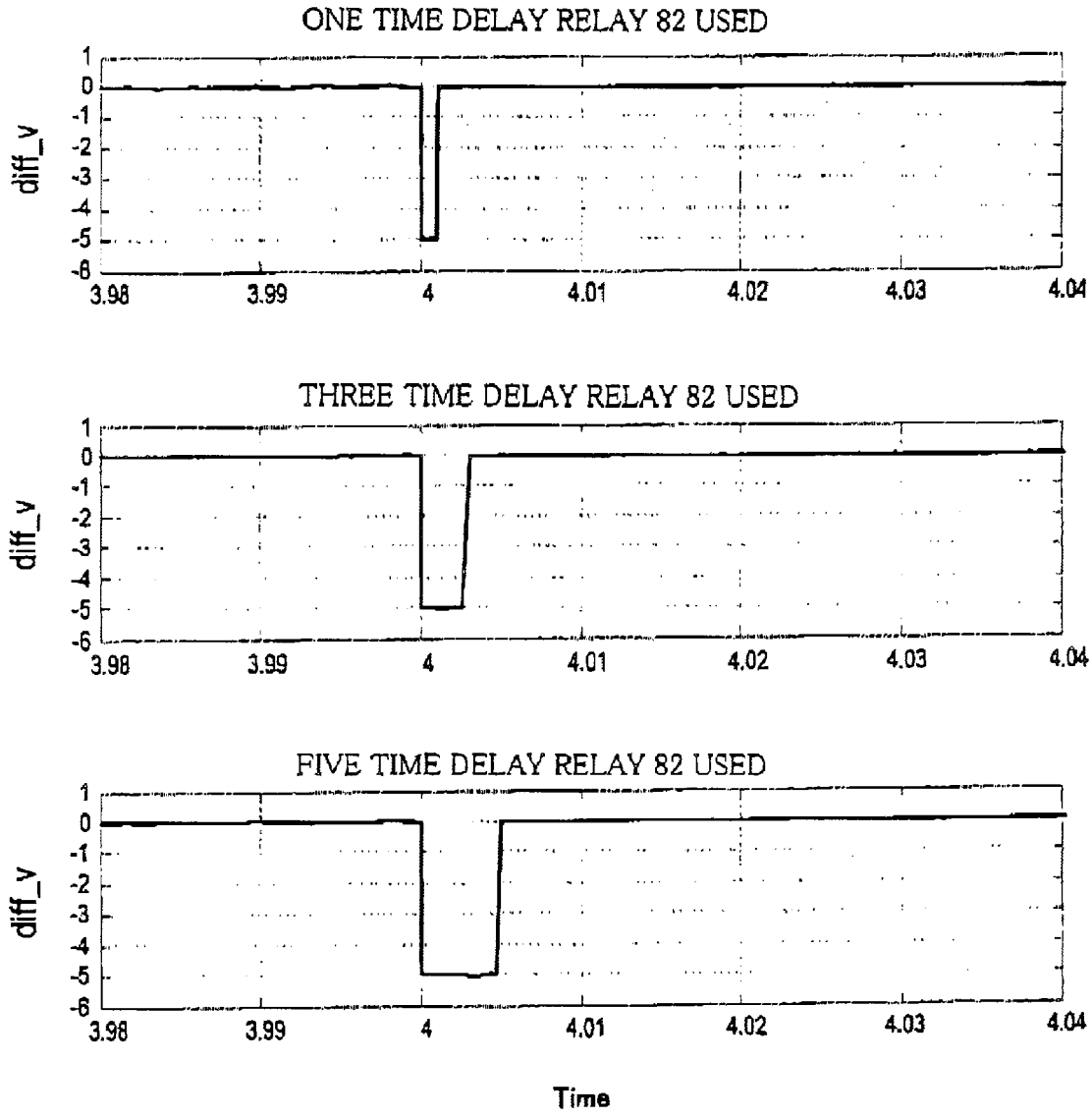
FIG. 11 is a graph representing only respective portions of the three time-wise changes, shown in FIG. 9, that correspond to a timing when the carriage impacts on a frame of the printer.

In FIG. 9, it is not easy to recognize differences among the respective time-wise changes of the difference values, diff_v, outputted by the difference obtaining portion 71, that correspond to the different numbers of time delay relays 82 employed by the same 71. Hence, FIG. 10 shows respective time-wise changes of the difference values, diff v, around the timing (three seconds after) when the carriage 12 passes through the resolution-change point C, such that the respective time-wise changes correspond to the different numbers of time delay relays 82; and FIG. 11 shows respective time-wise changes of the difference values, diff_v, around the timing (four seconds after) when the carriage 12 impacts on the frame 13, such that the respective time-wise changes correspond to the different numbers of time delay relays 82. In each of FIGS. 10 and 11, a scale of an axis of abscissas (i.e., an axis indicative of time) is magnified.

As shown in FIGS. 10 and 11, as the total number of the time delay relays 82 increases, a time duration in which respective absolute values, |diff_v|, of the difference values, diff_v, are kept large, increases. The respective absolute values, |diff_v|, of the difference values, diff_v, increase as the change of the detected velocity, enc_velocity, increases. Therefore, as the difference of the low and high resolutions α, β across the resolution-change point C increases, the absolute value, |diff_v|, increases; and as the velocity of the carriage 12 moving immediately before the carriage 12 impacts on the side frame 13 increases, the absolute value, |diff_v|, increases.

Back to FIG. 6, the point detector 72 of the point detecting portion 53 includes a first difference comparing portion 74 that judges, each time the difference obtaining portion 71 obtains a difference (i.e., a difference value), diff_v, at the predetermined period, whether the obtained difference, diff_v, is greater than an upper difference threshold value; a first accumulated-value calculating portion 75 that calculates an accumulated value (i.e., a change-point-detection accumulated value) by summing the difference values, diff_v, obtained while positive judgments are continuously made by the first difference comparing portion 74; a first threshold comparing portion 76 that judges whether the change-point-detection accumulated value calculated by the first accumulated-value calculating portion 75 is greater than a resolution-change-point-detection threshold value and, if a positive judgment is made, judges that the carriage 12 has passed through the resolution-change point C; a maximum-PWM-duty-ratio outputting portion 80 that outputs, when the first threshold comparing portion 76 judges that the change-point-detection accumulated value is greater than the resolution-change-point-detection threshold value, that is, judges that the carriage 12 has passed through the resolution-change point C, the second maximum PWM duty ratio as the maximum PWM duty ratio, pwm_max, to be inputted to the control portion 51; a second difference comparing portion 77 that judges, each time the difference obtaining portion 71 obtains a difference (i.e., a difference value), diff_v, at the predetermined period, whether the obtained difference, diff_v, is smaller than a lower difference threshold value; a second accumulated-value calculating portion 78 that calculates an accumulated value (i.e., an impact-point-detection accumulated value) by summing the difference values, diff_v, obtained while positive judgments are continuously made by the second difference comparing portion 77; and a second threshold comparing portion 79 that judges whether the impact-point-detection accumulated value calculated by the second accumulated-value calculating portion 78 is smaller than an impact-point-detection threshold value and, if a positive judgment is made, judges that the carriage 12 has impacted on the side frame 13, i.e., reached the impact point A.

When the second threshold comparing portion 79 judges that the impact-point-detection accumulated value is smaller than the impact-point-detection threshold value, that is, judges that the carriage 12 has impacted on the side frame 13, i.e., reached the impact point C, the maximum-PWM-duty-ratio outputting portion 80 outputs the impact-time maximum PWM duty ratio as the maximum PWM duty ratio, pwm_max, to be inputted to the control portion 51. The impact point C is determined as the origin of the carriage 12. When the carriage 12 moves in the low-resolution scale portion L, the maximum-PWM-duty-ratio outputting portion 80 outputs the first maximum PWM duty ratio as the maximum PWM duty ratio, pwm_max. Thus, after the carriage 12 has passed through the resolution-change point C, the maximum PWM duty ratio, pwm max, is lowered.

In the carriage driving apparatus 1 constructed as described above, the origin (i.e., home position) detecting operation is carried out by the ASIC 32 as a hardware element.

Figure 12:
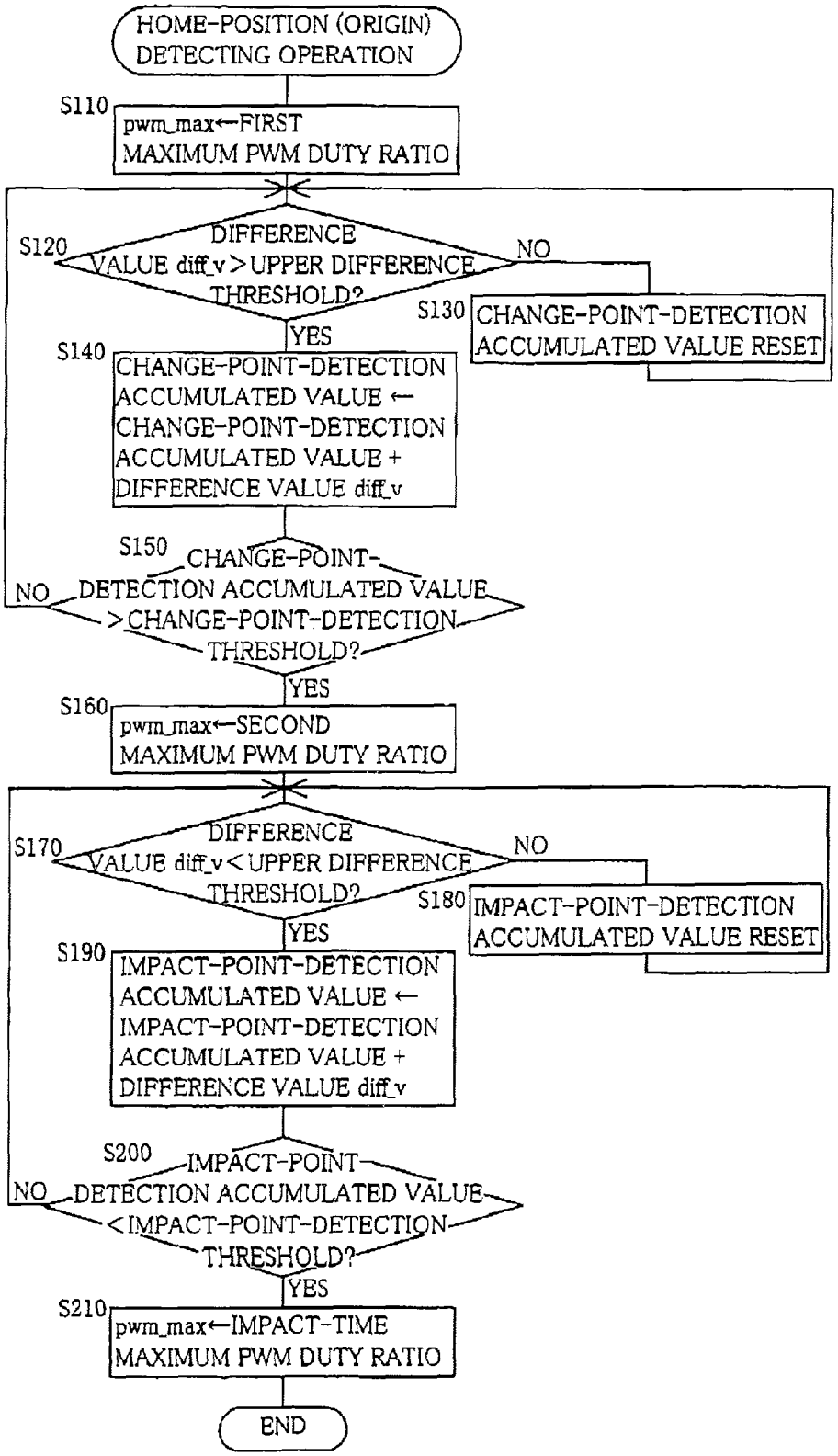
FIG. 12 is a flow chart representing the origin (home-position) detecting operation carried out by the control device (ASIC)

However, for easier understanding purposes only, the operation of the ASIC 32 to carry out the home-position detecting operation will be described by reference to a flow chart, shown in FIG. 12. In the home-position detecting operation, it is assumed that the carriage 12 is moved, at a constant velocity, from a predetermined position in the low-resolution scale portion L, toward the high-resolution scale portion H. Steps of the flow chart are mainly carried out by the point detecting portion 53.

When the home-position detecting operation is started, first, at Step S110, the maximum-PWM-duty-ratio outputting portion 80 reads, from the first-maximum-PWM-duty-ratio register 67, the first maximum PWM duty ratio as the maximum PWM duty ratio, pwm_max, and outputs the first maximum PWM duty ratio to the control portion 51. In this state, the carriage 12 is being moved at a constant velocity in the low-resolution scale portion L, toward the high-resolution scale portion H.

Subsequently, at Step S120, the first difference comparing portion 74 judges whether a difference, diff_v, obtained by the difference obtaining portion 71 is greater than the upper difference threshold value stored by the upper-difference-threshold-value register 61. If a negative judgment is made at Step S120, the operation proceeds with Step S130 where the first accumulated-value calculating portion 75 resets a current change-point-detection accumulated value, to zero. On the other hand, if a positive judgment is made at Step S120, the operation goes to Step S140 where the first accumulated-value calculating portion 75 adds the difference, diff_v, obtained by the difference obtaining portion 71, to the current change-point-detection accumulated value, and thereby obtain a new change-point-detection accumulated value.

Step S140 is followed by Step S150 where the first threshold comparing portion 76 judges whether the new change-point-detection accumulated value is greater than the resolution-change-point-detection threshold value stored by the resolution-change-point-detection-threshold-value register 64. If a negative judgment is made at Step S150, the operation goes back to Step S120. On the other hand, if a positive judgment is made at Step S150, it means that the carriage 12 has passed through the resolution-change point C and moved into the high-resolution scale portion H. Then, the operation goes to Step S160 where the maximum-PWM-duty-ratio outputting portion 80 reads, from the second-maximum-PWM-duty-ratio register 68, the second maximum PWM duty ratio as the maximum PWM duty ratio, pwm_max, and outputs the second maximum PWM duty ratio to the control portion 51.

Subsequently, at Step S170, the second difference comparing portion 77 judges whether the difference, diff_v, obtained by the difference obtaining portion 71 is smaller than the lower difference threshold value stored by the lower-difference-threshold-value register 62. If a negative judgment is made at Step S170, the operation goes to Step S180 where the second accumulated-value calculating portion 78 resets a current impact-point-detection accumulated value, to zero. On the other hand, if a positive judgment is made at Step S170, the operation goes to Step S190 where the second accumulated-value calculating portion 78 adds the difference, diff_v, obtained by the difference obtaining portion 71, to the current impact-point detection accumulated value, and thereby obtain a new impact-point-detection accumulated value.

Step S190 is followed by Step S200 where the second threshold comparing portion 79 judges whether the new impact-point-detection accumulated value is smaller than the impact-point-detection threshold value stored by the impact-point-detection-threshold-value register 65. If a negative judgment is made at Step S200, the operation goes back to Step S170. On the other hand, if a positive judgment is made at Step S200, it means that the carriage 12 has impacted on the side frame 13. Then, the operation goes to Step S210 where the maximum-PWM-duty-ratio outputting portion 80 reads, from the impact-time-maximum-PWM-duty-ratio register 69, the impact-time maximum PWM duty ratio as the maximum PWM duty ratio, pwm_max, and outputs the impact-time maximum PWM duty ratio to the control portion 51. However, at Step S210, the control portion 51 may control the driving-signal producing portion 52 to output a driving signal having a predetermined PWM duty ratio corresponding to a predetermined driving force, to the driver circuit 33.

As is apparent from the foregoing description of the carriage driving apparatus 1, the linear encoder 20 employs the linear scale 28 in which the encoder slits 29, 30 thereof are not formed at a same and one pitch over the entire detectable scale portion or length thereof, i.e., in which the entire detectable scale portion or length thereof is divided into the low-resolution scale portion L having the large pitch $\alpha$ and the high-resolution scale portion H having the small pitch $\beta$. In addition, the high-resolution scale portion H is located at a position nearer to the origin (i.e., home position) of the carriage 12, than the low-resolution scale portion L. In the origin detecting operation, when the carriage 12 is moved from the low-resolution scale portion L toward the origin, the carriage 12 passes through the resolution-change point C, i.e., moves from the low-resolution scale portion L to the high-resolution scale portion H. When the carriage 12 passes through the resolution-change point C, the "apparent" velocity, enc_velocity, calculated by the velocity calculating portion 50 abruptly increases Hence, the carriage driving apparatus 1 operates, under the feedback control, to change the calculated velocity toward the target velocity. As the calculated velocity is changed toward the target velocity, the actual velocity of the carriage 12 is lowered at a rate corresponding to a difference of the low resolution $\alpha$ and the high resolution $\beta$.

Thus, after the carriage 12 has passed through the resolution-change point C, the actual velocity of the carriage 12 is lowered, and accordingly an impact force produced when the carriage 12 impacts on the side frame 13 is reduced. That is, the software and hardware constructions of the carriage driving apparatus 1 do not largely differ from those of the conventional feedback control device, but just the linear scale 28 of the linear encoder 20 includes the plurality of scale portions L, H having the different slit intervals (i.e., different resolutions) $\alpha$, $\beta$. Therefore, the present carriage driving apparatus 1 can detect or calibrate the origin of the carriage 12, without needing to complicate the construction thereof or excessively lower the operation speed thereof, while the impact force produced when the carriage 12 impacts on the side frame 3 is effectively reduced.

In addition, based on the difference value, diff_v, as the amount of change of the calculated velocity, enc_velocity, it is judged whether the carriage 12 has passed through the resolution-change point C and, after the passing, the maximum PWM duty ratio is lowered. Thus, after the carriage 12 has impacted on the side frame 13, no excessively high electric current is supplied to the motor 10. Therefore, the present carriage driving apparatus 1 can be prevented from being deteriorated or damaged.

In addition, each time the difference value, diff_v, is calculated at the regular interval of time, i.e., at the predetermined period, the calculated difference value, diff_v, is compared with each of the upper and lower difference threshold values. Therefore, whether the carriage 12 has passed through the resolution-change point C and whether the carriage 12 has impacted on the side frame 13 can be judged with reliability.

Each of the calculated difference values, diff_v, is not just compared with the upper and lower difference threshold values, but those values are summed up so long as they continue to be greater than the upper difference threshold value or continue to be lower than the lower difference threshold value When the summed-up or accumulated value has exceeded the resolution-change-point-detection threshold value, it is judged that the carriage 12 has passed through the resolution-change point C; and when the summed-up or accumulated value has exceeded the impact-point-detection threshold value, it is judged that the carriage 12 has impacted on the side frame 13. Thus, even if the calculated velocity, enc_velocity, may be temporarily largely changed by some influence such as noise, the influence can be canceled. Therefore, the above-indicated judgments can be made with reliability.

In the present embodiment, the first difference comparing portion 74 corresponds to a velocity-increase judging portion; the first threshold comparing portion 76 corresponds to a velocity-increase-state-continuation judging portion; the second difference comparing portion 77 corresponds to a velocity-decrease judging portion; the second threshold comparing portion 79 corresponds to a velocity-increase-state-continuation judging portion; and the maximum-PWM-duty ratio producing portion 80 corresponds to a maximum-driving-force selecting portion and an impact-time maximum-driving-force selecting portion. In addition, the difference calculating portion 71, the first difference comparing portion 74, the first accumulated-value calculating portion 75, and the first threshold comparing portion 76 cooperate with each other to constitute an object-movement judging portion; and the difference calculating portion 71, the second difference comparing portion 77, the second accumulated-value calculating portion 78, and the second threshold comparing portion 79 cooperate with each other to constitute a stopping judging portion.

Preferably, the upper difference threshold value set in the upper-difference-threshold-value register 61 of the point-detection-threshold register group 37 is so determined as to be able to detect such difference values, diff_v, that are greater than normal difference values that can be obtained under the feedback control, i.e., detect such changes of the velocity of the carriage 12 that cannot usually occur. Usually, an object to be controlled has a mechanical time constant corresponding to, e.g., a mass, friction, and/or a spring element(s). Therefore, if a difference value, diff_v, that cannot occur is detected, then it can be judged that the carriage 12 has passed through the resolution-change point C.

In addition, preferably, the difference calculating portion 71 employs two or more time delay relays 82 so as to prevent other points than the resolution-change point C, from being incorrectly judged as the point C because of disturbance such as noise at the different points.

Second Embodiment

Next, a second embodiment of the present invention will be described by reference to FIGS. 13 and 14. The second embodiment also relates to a carriage driving apparatus of an ink-jet printer, and differs from the carriage driving apparatus 1 as the first embodiment, only in that though the slit intervals β of the high-resolution scale portion H of the linear scale 28 employed in the first embodiment are constant, intervals of encoder slits 92 of a high-resolution scale portion H' of a linear scale 90 of a linear encoder employed in the second embodiment gradually decrease in a direction toward the origin (i.e., home position) of the carriage 12. The same reference numerals as used in the first embodiment are used to designate the corresponding elements or parts of the second embodiment, and the description thereof is omitted. Hereinafter, only differences of the first and second embodiments will be described.

Figure 13:
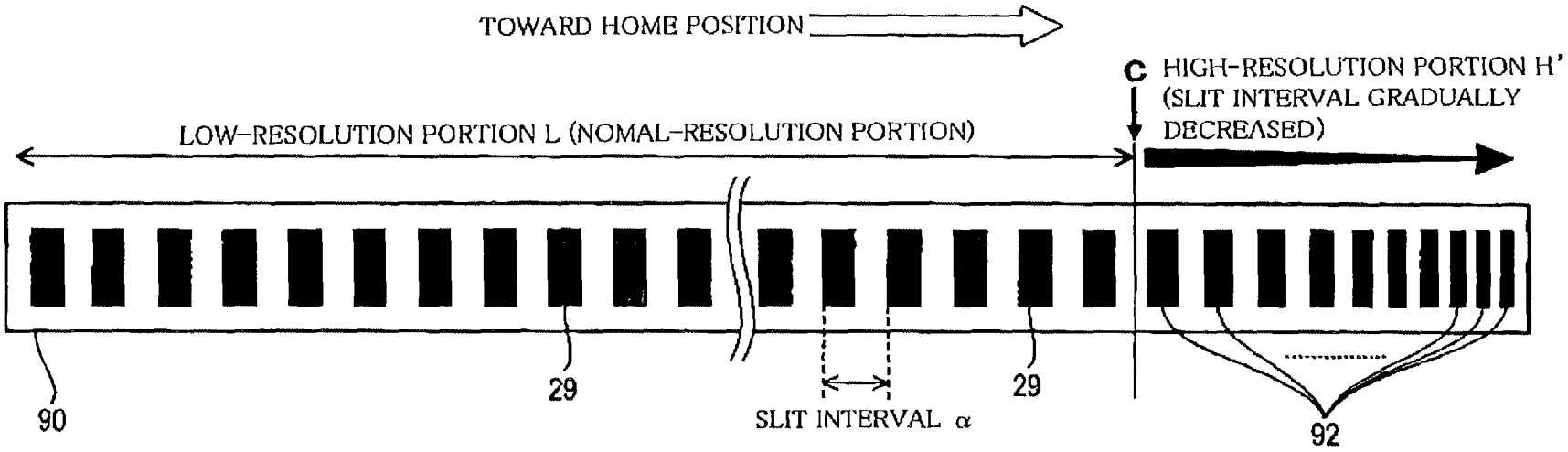
FIG. 13 is a plan view corresponding to FIG. 5 and showing another linear scale of another linear encoder that is employed by the carriage driving apparatus of FIG. 1 in a second embodiment of the present invention.

As is apparent from the comparison of the linear scale 90, shown in FIG. 13, with the linear scale 28 (FIG. 5) employed in the first embodiment, resolutions corresponding to the intervals of the encoder slits 92 formed in the high-resolution scale portion H' of the linear scale 90 gradually increase in a direction toward the side frame 13, i.e., the origin of the carriage 12. More specifically described, a slit interval of an adjacent portion of the high-resolution scale portion H' that is adjacent to the low-resolution scale portion L having the large or normal slit interval α, is smaller than the large slit interval α, and is larger than the small slit interval β of the high-resolution scale portion H of the linear scale 28. In addition, the slit interval of the adjacent portion of the high-resolution scale portion H' is so determined as to assure that when the carriage 12 is moved from the low-resolution scale portion L into the high-resolution scale portion H' via the resolution-change point C, the resolution-change point C can be detected by the point detecting portion 53 (FIG. 6). In other words, the resolution (i.e., the slit interval) of the adjacent portion of the high-resolution scale portion H' is so determined as to assure that the difference value, diff_v, obtained by the difference obtaining portion 71 when the carriage 12 passes through the resolution-change point C exceeds the upper difference threshold value.

As the distance from the resolution-change point C in the direction toward the side frame 13 increases, the slit intervals of the high-resolution scale portion H' stepwise decrease, one slit 92 by one.

Figure 14:
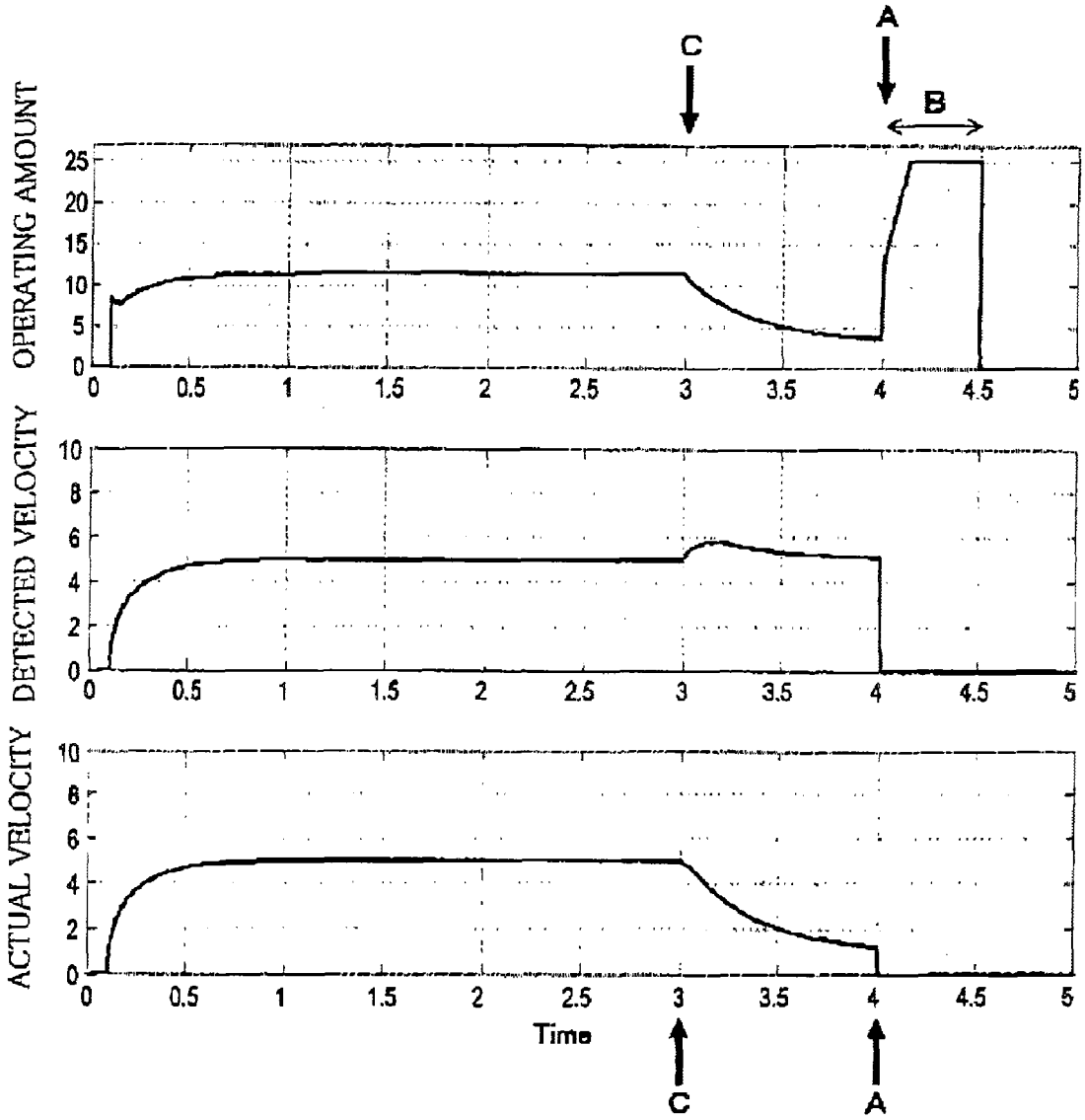
FIG. 14, is a graph corresponding to FIG. 8 and representing respective time-wise changes of an actual velocity of a carriage of the printer, a detected (i.e., calculated) velocity of the carriage, detected (i.e., calculated) by the velocity calculating portion of the control device, and, a motor operating amount, each in an origin (or home-position) detecting operation carried out using the linear encoder of FIG. 13.

Since the linear scale 90 is arranged as described above, an actual velocity of the carriage 12, a calculated or apparent speed, enc_velocity, of the same 12 (calculated by the velocity calculating portion 50), and a motor operating amount (i.e., a duty ratio of a PWM signal inputted to the drive circuit 33), each during an origin detecting operation, change as shown in FIG. 14 corresponding to FIG. 8 in connection with the first embodiment.

As shown in FIG. 14, since the resolutions of the high-resolution scale portion H' gradually change (i.e., increase), the calculated velocity of the carriage 12 at the time of passing through the resolution-change point C does not change so abruptly as the calculated velocity of the same 12 in connection with the first embodiment. Thus, a rate of change of the motor operating amount after the passing is smaller as compared with the first embodiment. Therefore, an acceleration of the carriage 12 is not largely influenced and the actual velocity thereof is slowly changed.

Thus, in not only the first embodiment but the second embodiment, the actual velocity of the carriage 12 can be lowered before the carriage 12 impacts on the side frame 13. That is, the software and hardware constructions of the present carriage driving apparatus do not largely differ from those of the conventional feedback control device, but just the linear scale 90 of the linear encoder includes not only the low-resolution scale portion L but the high-resolution scale portions H', as shown in FIG. 13. Therefore, the present carriage driving apparatus can accurately determine or calibrate the origin of the carriage 12, while the impact force produced when the carriage 12 impacts on the side frame 3 is effectively reduced.

Third Embodiment

Next, a third embodiment of the present invention will be described by reference to FIG. 15. The third embodiment also relates to a carriage driving apparatus of an ink-jet printer, and differs from the carriage driving apparatus 1 as the first embodiment, only with respect to a manner of judging whether the carriage 12 has impacted on the side frame 13. In the first embodiment, the home-position detecting operation is carried out according to the flow chart shown in FIG. 12, so as to judge whether the carriage 12 has passed through the resolution-change point C, based on the difference values, diff_v, obtained by the difference obtaining portion 71, and likewise judge, based on the difference values, diff_v, whether the carriage 12 has impacted on the side frame 13 after having passed through the resolution-change point C. However, in the third embodiment, the carriage driving apparatus judges whether the carriage 12 has impacted on the side frame 13, by judging whether the carriage 12 has moved over a predetermined distance from the resolution-change point C. The same reference numerals as used in the first embodiment are used to designate the corresponding elements or parts of the third embodiment, and the description thereof is omitted. Hereinafter, only differences of the first and third embodiments will be described.

Figure 15:
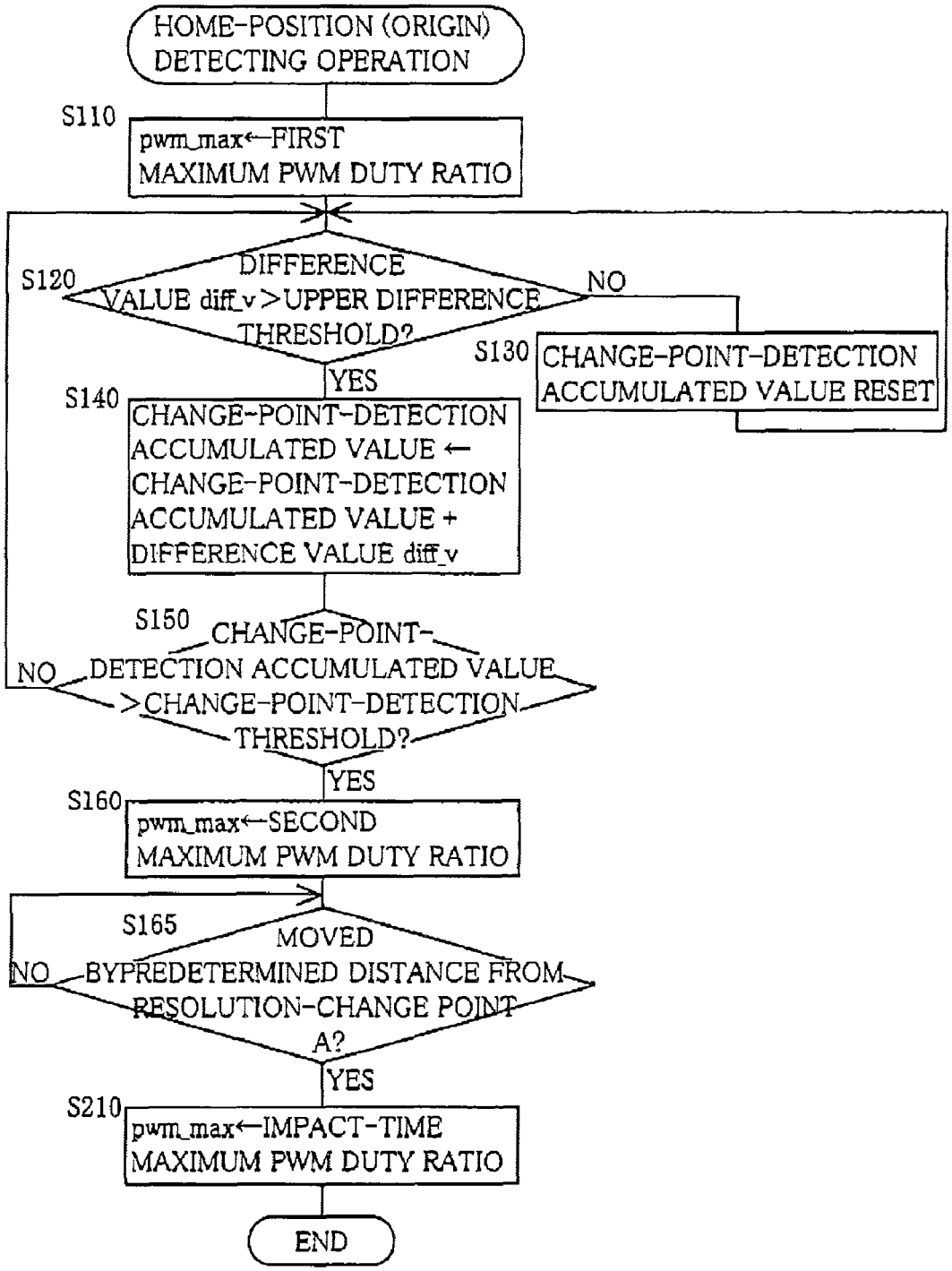
FIG. 15 is a flow chart corresponding to FIG. 12 and representing an origin (home-position) detecting operation that is carried out by another control device (ASIC) employed by another carriage driving apparatus as a third embodiment of the present invention.

FIG. 15 shows a flow chart representing a home-position detecting operation carried out in the third embodiment. As is apparent from the comparison of the home-position detecting operation, shown in FIG. 15, with the home-position detecting operation (FIG. 12) carried out in the first embodiment, Steps S110 through S160 of FIG. 15 that are carried out to judge whether the carriage 12 has passed through the resolution-change point C are identical with Steps S110 through S160 of FIG. 12, respectively. Thus, the description of those steps is omitted.

In the present embodiment, Step S160 is followed by Step S165 to judge whether the carriage 12 has moved over a predetermined distance from the resolution-change point C detected at Step S150. The predetermined distance is equal to a distance between the resolution-change point C and the side frame 13, and can be known in advance. Theoretically, if the carriage 12 has moved by the predetermined distance from the resolution-change point C, then the carriage 12 should just impact on the side frame 13.

Thus, unlike the first embodiment in which the change of velocities of the carriage 12 (i.e., the difference value, diff_v) when the carriage 12 impacts on the side frame 13 is utilized, the present embodiment is adapted to detect the impaction of the carriage 12 by judging whether the carriage 12 has moved by the predetermined distance from the resolution-change point C. A distance of movement of the carriage 12 in the high-resolution scale portion H can be easily known from the counted edge number, enc_count, shown in FIG. 4. Thus, Step S165 corresponds to a predetermined-distance-movement judging portion.

If a positive judgment is made at Step S165, then it is judged that the carriage 12 has moved by the predetermined distance from the resolution-change point C, i.e., that the carriage 12 has reached the impact point A. Hence, the operation proceeds with Step S210 to set, as the maximum PWM duty ratio, pwm_max, the impact-time maximum PWM duty ratio. Step S210 of FIG. 15 is identical with Step S210 of FIG. 12. Therefore, at Step S210, the control portion 51 may control the driving-signal producing portion 52 to output a driving signal having a predetermined PWM duty ratio corresponding to a predetermined driving force, to the driver circuit 33.

Since, in the third embodiment, the impact point A is detected based on the movement distance of the carriage 12 in the high-resolution scale portion H, the point detecting portion 53 need not include the elements needed to detect the impact point A, i.e., the second difference comparing portion 77, the second accumulated-value calculating portion 78, or the second threshold comparing portion 79. Thus, the impact point A can be more easily detected. This leads to simplifying the construction of the carriage driving apparatus and reducing the production cost of the same.

Fourth Embodiment

Figure 16:
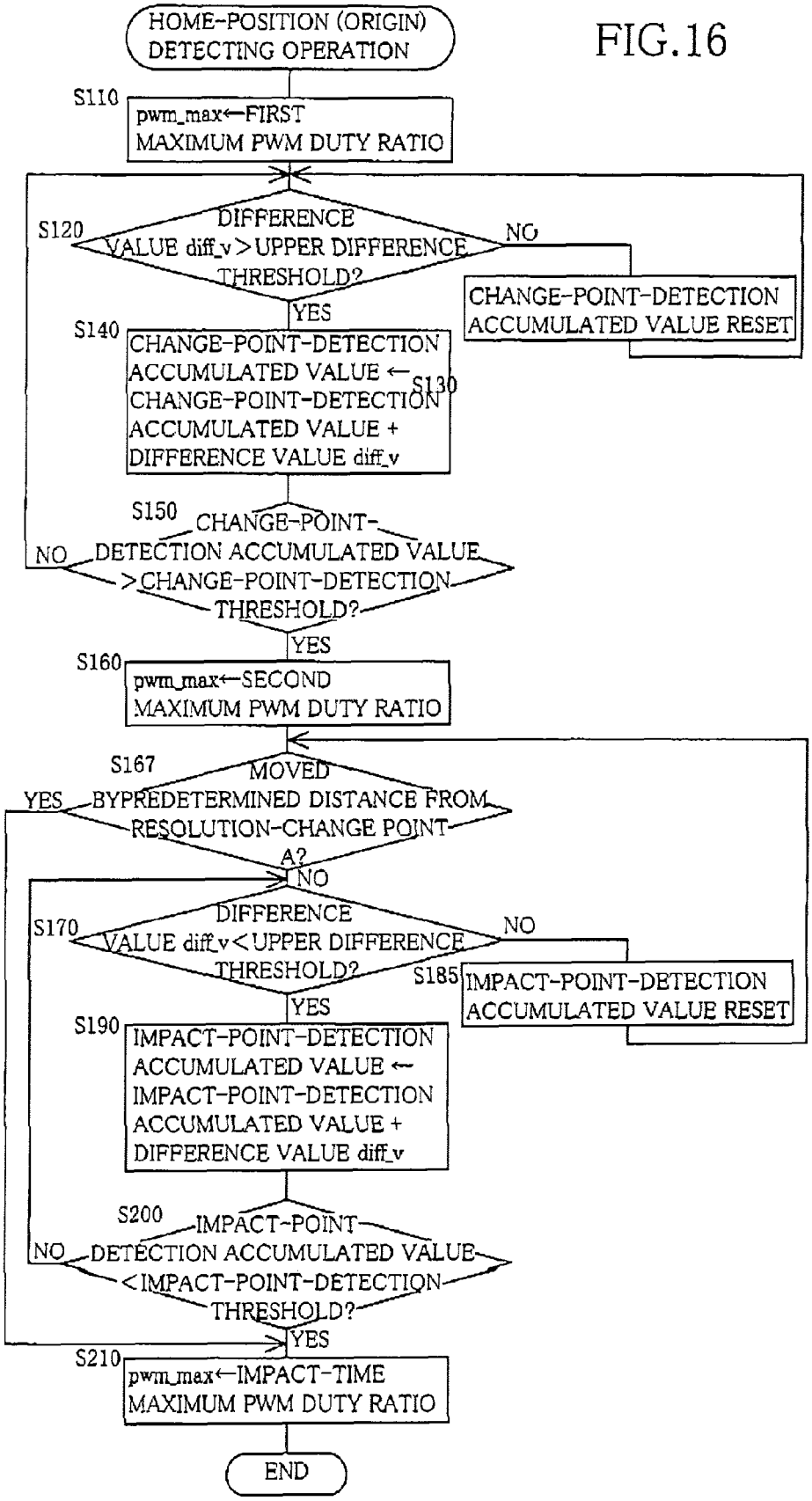
FIG. 16 is a flow chart corresponding to FIG. 12 and representing an origin (home-position) detecting operation that is carried out by another control device (ASIC) employed by another carriage driving apparatus as a fourth embodiment of the present invention.

Next, a fourth embodiment of the present invention will be described by reference to FIG. 16. The fourth embodiment also relates to a carriage driving apparatus of an ink-jet printer, and differs from the carriage driving apparatus 1 as the first embodiment, only with respect to a manner of judging whether the carriage 12 has impacted on the side frame 13. FIG. 16 shows a home-position detecting operation that is carried out in the fourth embodiment and that is obtained by combining the home-position detecting operation (FIG. 12) carried out in the first embodiment, with the home-position detecting operation (FIG. 15) carried out in the third embodiment. More specifically described, the flow chart of FIG. 16 is obtained by inserting Step S165 of FIG. 15 between Steps S160 and S170 of FIG. 12. The same reference numerals as used in the first and third embodiments are used to designate the corresponding elements or parts of the fourth embodiment, and the description thereof is omitted.

In the home-position detecting operation shown in FIG. 16, if at Step S150, it is judged that the carriage 12 has passed through the resolution-change point C and, at Step S160, the second maximum PWM duty ratio is set as the maximum PWM duty ratio, pwm_max, then the operation goes to Step S165 to judge whether the carriage 12 has moved by the predetermined distance from the resolution-change point C detected at Step S150.

If a positive judgment is made at Step S165, then it is judged that the carriage 12 has moved by the predetermined distance from the resolution-change point C, i.e., that the carriage 12 has reached the impact point A. Hence, the operation proceeds with Step S210. On the other hand, if a negative judgment is made at Step S165, the operation goes to Step S170 and the following steps. Steps S170, S190, and S200 of FIG. 16 are identical with Steps S170, S190, and S200 of FIG. 12, respectively. If a negative judgment is made at Step S170, the operation goes to Step S185 to reset the impact-point-detection accumulated value, to zero. Then, the operation goes back to Step S165. Step S185 of FIG. 16 is similar to Step S180 of FIG. 12 in that the impact-point-detection accumulated value is reset to zero, but differs from the latter in that Step S185 is followed by not Step S170 but Step S165.

For example, in the case where one or more encoder slits 29 formed in the high-resolution scale portion H are clogged with, e.g., dust and cannot transmit light, it may be repeatedly judged, at Step S165, that the carriage 12 has not moved by the predetermined distance, though, in fact, the carriage 12 has actually impacted on the side frame 13. Even in this case, however, Steps S170 through S200 of FIG. 16 can detect the change of the velocities of the carriage 12, caused by the impacting thereof on the side frame 13, and judge that the carriage 12 has impacted on the frame 13. Therefore, the impact point A can be detected with higher reliability.

Fifth Embodiment

Next, a fifth embodiment of the present invention will be described by reference to FIG. 17. The fifth embodiment also relates to a carriage driving apparatus of an ink-jet printer, and differs from the carriage driving apparatus 1 as the first embodiment, only with respect to a manner of judging whether the carriage 12 has passed through the resolution-change point C and a manner of judging whether the carriage 12 has impacted on the side frame 13.

In the first embodiment, whether the carriage 12 has passed through the resolution-change point C is judged by accumulating the difference values, diff_v, obtained by the difference obtaining portion 71 while each of those difference values, diff_v, is consecutively judged as being greater than the upper difference threshold value, and judging that the accumulated value has exceeded the resolution-change-point threshold value. Likewise, whether the carriage 12 has impacted on the side frame 13 is judged by accumulating the difference values, diff_v, obtained while each of those difference values, diff_v, is consecutively judged as being smaller than the lower difference threshold value, and judging that the accumulated value has decreased below the impact-point threshold value. However, in the fifth embodiment, whether the carriage 12 has passed through the resolution-change point C is judged by judging whether a state in which each of the consecutive difference values, diff_v, is greater than the upper difference threshold value has continued for more than a first predetermined time duration and, likewise, whether the carriage 12 has impacted on the side frame 13 is judged by judging whether a state in which each of the consecutive difference values, diff_v, is smaller than the lower difference threshold value has continued for more than a second predetermined time duration.

Figure 17:
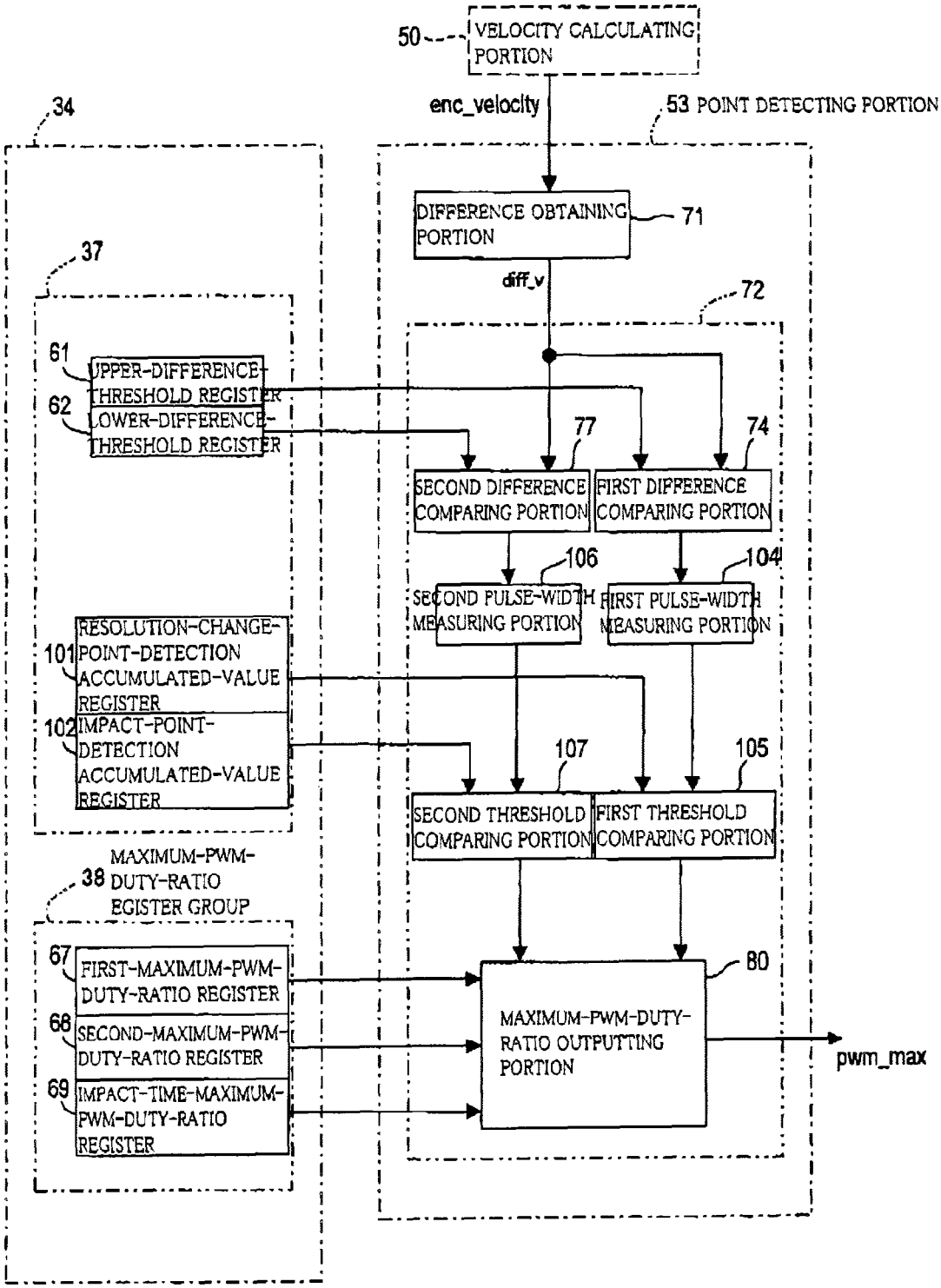
FIG. 17 is a diagrammatic view of respective internal arrangements of a point-detection-threshold register group, a maximum-PWM-duty-ratio register group, and a point detecting portion of another control device (ASIC) employed by another carriage driving apparatus as a fifth embodiment of the present invention.

FIG. 17 shows respective internal arrangements of the point-detection-threshold register group 37, the maximum-PWM-duty-ratio register group 38, and the point detecting portion 53 of the ASIC 32 employed in the present embodiment. The same reference numerals as used in the first embodiment (e.g., in FIG. 6) are used to designate the corresponding elements or parts of the fifth embodiment, and the description thereof is omitted.

As is apparent from FIG. 17, a first pulse-width measuring portion 104 of the point detecting portion 53 measures a time period in which each of the difference values, diff_v, obtained by the difference obtaining portion 71 is consecutively judged as being greater than the upper difference threshold value by the first difference comparing portion 74, i.e., measures a width of a pulse, shown in FIG. 10, representing the obtained difference values, diff_v, each of which is greater than the upper difference threshold value (e.g., 3). A resolution-change-point-detection time threshold register 101 stores a resolution-change-point-detection time threshold value. A first threshold comparing portion 105 judges whether the time period or pulse width measured by the first pulse-wise measuring portion 104, is longer or larger than the resolution-change-point-detection time threshold value. If a positive judgment is made, the first threshold comparing portion 105 judges that the carriage 12 has passed through the resolution change point C. Thus, the maximum-PWM-duty-ratio producing portion 80 produces and sets, as the maximum PWM duty ratio; pwm_max, the second maximum PWM duty ratio.

Likewise, a second pulse-width measuring portion 106 of the point detecting portion 53 measures a time period in which each of the obtained difference values, diff_v, is consecutively judged as being smaller than the lower difference threshold value by the second difference comparing portion 77, i.e., measures a width of a pulse, shown in FIG. 11, representing the obtained difference values, dif_v, each of which is smaller than the lower difference threshold value (e.g., −3). An impact-point-detection time threshold register 102 stores an impact-point-detection time threshold value. A second threshold comparing portion 107 judges whether the time period or pulse width measured by the second pulse-wise measuring portion 104, is longer or larger than the impact-point-detection time threshold value. If a positive judgment is made, the second threshold comparing portion 107 judges that the carriage 12 has impacted on the side frame 13. Thus, the maximum-PWM-duty-ratio producing portion 80 produces and sets, as the maximum PWM duty ratio, pwm_max, the impact-time maximum PWM duty ratio.

While the present invention has been described in its preferred embodiments, it is to be understood that the present invention may otherwise be embodied.

For example, in each of the first and second embodiments, the high-resolution scale portion H, H' is provided in only one of the lengthwise opposite end portions of the linear scale 28, 90, as shown in FIG. 5 or FIG. 13. However, in a modified form, shown in FIG. 18, of the first or second embodiment, a linear scale 95 has two high-resolution scale portions H in lengthwise opposite end portions thereof, respectively. In this modified form, even if the carriage 12 may be moved, for some reason, toward the left side frame 14 and eventually impact on the same 14, the velocity of the carriage 12 is lowered before the carriage 12 impacts on the frame 14. Thus, an impact force produced when the carriage 12 impacts on the frame 14 can be reduced.

Figure 18:
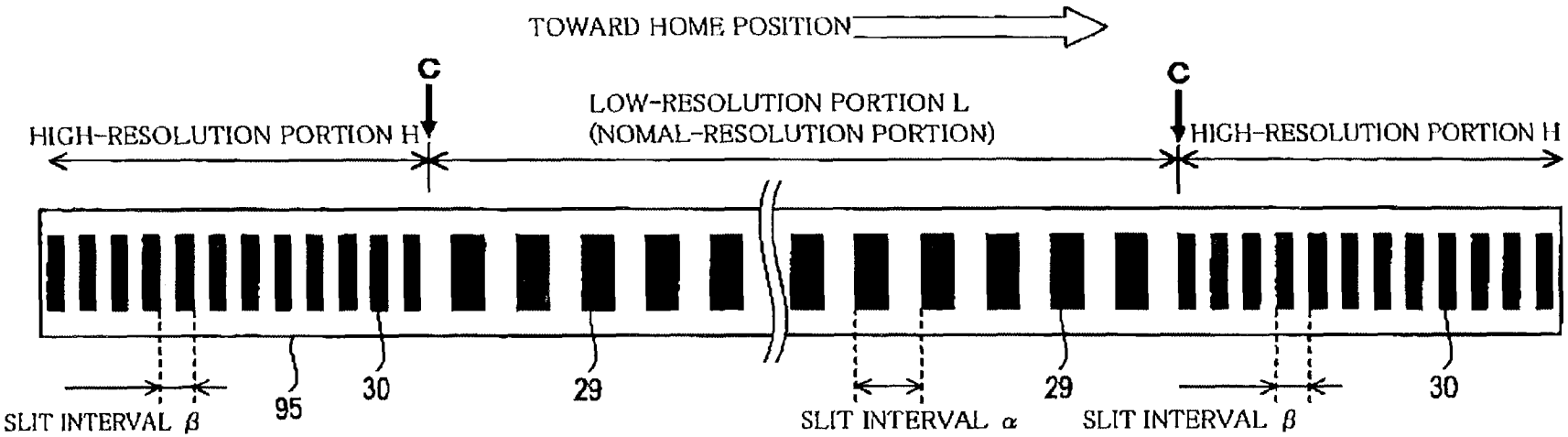
FIG. 18 is a plan view corresponding to FIG. 5 and showing another linear scale of another linear encoder that is employed by the carriage driving apparatus of FIG. 1 in a modified form of the first embodiment.
Figure 19:
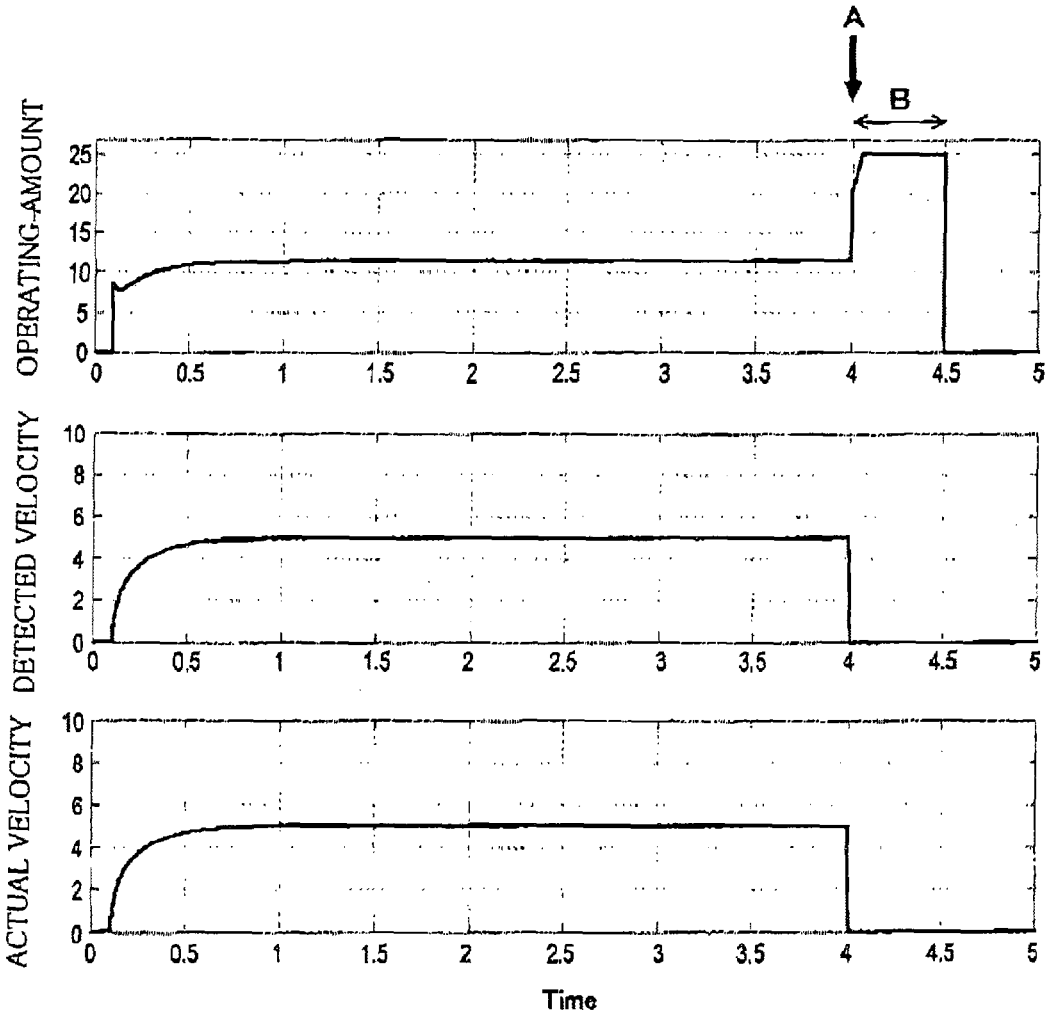
FIG. 19 is a graph corresponding to FIG. 8 and representing respective time-wise changes of an actual velocity of a carriage of the printer, a detected (i.e., calculated) velocity of the carriage, detected (i.e., calculated) by the velocity calculating portion of the control device, and a motor operating amount, each in an origin (home-position) detecting operation carried out by a conventional printer.

In the modified form shown in FIG. 18, each of the two high-resolution scale portions H of the linear scale 95 has the constant slit intervals β. However, the linear scale 95 may be replaced by another linear scale having, in two lengthwise opposite end portions thereof, two high-resolution scale portions H', respectively, each of which is similar to the high-resolution scale portion H' shown in FIG. 13.

In the first embodiment, whether the carriage 12 has impacted on the side frame 13 in the origin (home-position) detecting operation is judged based on the difference values, diff_v, obtained by the difference obtaining portion 71. However, this judgment may by made based on a time period in which the operating amount to operate the motor 10 is saturated, i.e. is continuously kept at the second maximum PWM duty ratio.

In each of the first to fifth embodiments, the optical linear encoder 20 is employed. However, the optical linear encoder 20 may be replaced with a magnetic linear encoder including a linear scale having north-pole (N) magnets and south-pole (S) magnets that are alternately arranged with each other; or an electromagnetic-reduction-type linear encoder. That is, it is possible to employ any sort of linear encoder whose linear scale has, in a high-resolution scale portion near the home position (i.e., the origin), a plurality of detectable portions that are provided at an interval or intervals smaller than regular intervals at which detectable portions are provided in a low-resolution scale portion remoter from the home position than the high-resolution scale portion.

In each of the first to fifth embodiments, the rotary driving force of the rotary motor 10 as a drive source is converted into the linear driving force that reciprocates the carriage 12 relative to the main frame or housing of the ink-jet printer or the carriage driving apparatus. However, the rotary motor 10 may be replaced with a linear motor. In addition, the drive source is not limited to motors. That is, the present invention is applicable to any device or system that drives and controls an object based on an output of a linear encoder.

It is to be understood that the present invention may be embodied with other changes and improvements that may occur to a person skilled in the art, without departing from the spirit and scope of the invention defined in the claims.

What is claimed is:

1. A driving apparatus, comprising:

a driving device which moves an object along a predetermined path;

a linear encoder including a linear scale and a detector at least one of which is moved relatively to an other of the linear scale and the detector when the object is moved along the predetermined path by the driving device;

a control device which controls, based on an output of the detector, the driving device to move the object along the predetermined path; and at least one stopper on which the object impacts when the object is moved along the predetermined path, so that said at least one stopper stops a further movement of the object, wherein the linear scale includes (a) at least one first scale portion having a plurality of first detectable portions provided at a first predetermined pitch, and (b) at least one second scale portion having a plurality of second detectable portions including at least one first pair of adjacent second detectable portions which are adjacent to each other and which are distant from each other by a first predetermined distance smaller than the first predetermined pitch, wherein said at least one first scale portion and said at least one second scale portion are located relative to each other such that when the object is moved toward said at least one stopper, the detector first detects the first detectable portions and then detects the second detectable portions, while sequentially outputting a plurality of detection signals each of which indicates a detection of a corresponding one of the first detectable portions and the second detectable portions, and the control device controls, based on the detection signals sequentially outputted by the detector, the driving device to move the object along the predetermined path, such that the object is moved at at least one first actual velocity in at least one first path portion of the predetermined path that corresponds to said at least one first scale portion and is moved at at least one second actual velocity lower than said at least one first actual velocity, in at least one second path portion of the predetermined path that corresponds to said at least one second scale portion until the object impacts on said at least one stopper at a reduced velocity less than said at least one first actual velocity wherein the linear scale is provided along the predetermined path, such that said at least one second scale portion of the linear scale is nearer to said at least one stopper than said at least one first scale portion of the linear scale, so that when the object is moved to said at least one stopper, the object is moved from said at least one first path portion into said at least one second path portion, and wherein the second detectable portions include, in addition to at least one first pair of adjacent second detectable portions as said at least one pair of adjacent second detectable portions which are distant from each other by the first predetermined distance, at least one second pair of adjacent second detectable portions which are distant from each other by a second predetermined distance smaller than the first predetermined distance and which are nearer to said at least one stopper than said at least one first pair of adjacent second detectable portions.

2. The driving apparatus according to claim 1, wherein the control device includes a velocity obtaining portion which obtains, based on the plurality of detection signals and a reference value, a plurality of velocities of the object, and wherein the control device controls, based on the obtained velocities of the object, the driving device to move the object along the predetermined path.

3. The driving apparatus according to claim 2, wherein said at least one stopper is provided in a vicinity of at least one of opposite ends of the predetermined path and engages, when the object is moved to said at least one end, the object and thereby stops the further movement of the object, and wherein the first predetermined distance is smaller than each of the first predetermined pitch and a reference pitch as the reference value.

4. The driving apparatus according to claim 3, wherein the reference pitch is equal to the first predetermined pitch.

5. The driving apparatus according to claim 3, wherein the velocity obtaining portion obtains each of the plurality of velocities of the object, based on the reference pitch and a time period between a corresponding one pair of adjacent detection signals of a plurality of pairs of adjacent detection signals of the plurality of detection signals.

6. The driving apparatus according to claim 3, wherein the control device further includes a reference-position determining portion which detects at least one stop position where the further movement of the object is stopped by said at least one stopper, and which determines, based on the detected at least one stop position, at least one reference position of the object, wherein the reference-position determining portion includes a stop-position detecting portion which detects said at least one stop position, based on at least one of the plurality of detection signals; and a determining portion which determines said at least one reference position of the object, based on said at least one stop position detected by the stop-position detecting portion.

7. The driving apparatus according to claim 3, wherein said at least one first scale portion of the linear scale is adjacent to said at least one second scale portion thereof.

8. The driving apparatus according to claim 3, wherein said at least one second scale portion of the linear scale has at least three said second detectable portions provided at a second predetermined pitch smaller than each of the first predetermined pitch and the reference pitch.

9. The driving apparatus according to claim 1, wherein said at least one first scale portion include a plurality of first alternate portions arranged at the first predetermined pitch, and a plurality of second alternate portions which are arranged at the first predetermined pitch and are alternately arranged with the first alternate portions and each of which is physically distinguishable from each of the first alternate portions, and the first detectable portions of said at least one first scale portion include the first alternate portions, and wherein said at least one second scale portion include a plurality of third alternate portions, and a plurality of fourth alternate portions which are alternately arranged with the third alternate portions and each of which is physically distinguishable from each of the third alternate portions, and the second detectable portions of said at least one second scale portion include the third alternate portions.

10. The driving apparatus according to claim 9, wherein the first alternate portions and the second alternate portions of said at least one first scale portion include a plurality of first slits formed at the first predetermined pitch, and a plurality of first light-reflecting portions which are provided at the first predetermined pitch and are alternately arranged with the first slits, and wherein the third alternate portions and the fourth alternate portions of said at least one second scale portion include a plurality of second slits, and a plurality of second light-reflecting portions which are alternately arranged with the second slits.

11. The driving apparatus according to claim 1, wherein said at least one second scale portion includes at least one of lengthwise opposite end portions of the linear scale.

12. The driving apparatus according to claim 1, wherein a length of said at least one second scale portion is smaller than 30% of a sum of respective lengths of said at least one first scale portion and said at least one second scale portion.

13. The driving apparatus according to claim 1, wherein the predetermined distance of said at least one pair of adjacent second detectable portions of said at least one second scale portion is smaller than 80% of the first predetermined pitch of the first detectable portions of said at least one first scale portion.

14. A driving apparatus, comprising:

a driving device which moves an object along a predetermined path;

a linear encoder including a linear scale and a detector at least one of which is moved relatively to an other of the linear scale and the detector when the object is moved along the predetermined path by the driving device;

a control device which controls, based on an output of the detector, the driving device to move the object along the predetermined path; and at least one stopper on which the object impacts when the object is moved along the predetermined path, so that said at least one stopper stops a further movement of the object, wherein the linear scale includes (a) at least one first scale portion having a plurality of first detectable portions provided at a first predetermined pitch, and (b) at least one second scale portion having a plurality of second detectable portions including at least one first pair of adjacent second detectable portions which are adjacent to each other and which are distant from each other by a first predetermined distance smaller than the first predetermined pitch, wherein said at least one first scale portion and said at least one second scale portion are located relative to each other such that when the object is moved toward said at least one stopper, the detector first detects the first detectable portions and then detects the second detectable portions, while sequentially outputting a plurality of detection signals each of which indicates a detection of a corresponding one of the first detectable portions and the second detectable portions, and the control device controls, based on the detection signals sequentially outputted by the detector, the driving device to move the object along the predetermined path, such that the object is moved at at least one first actual velocity in at least one first path portion of the predetermined path that corresponds to said at least one first scale portion, and is moved at at least one second actual velocity lower than said at least one first actual velocity, in at least one second path portion of the predetermined path that corresponds to said at least one second scale portion, until the object impacts on said at least one stopper at a reduced velocity less than said at least one first actual velocity, wherein the control device includes a velocity obtaining portion which obtains, based on the plurality of detection signals and a reference value, a plurality of velocities of the object, and wherein the control device controls, based on the obtained velocities of the object, the driving device to move the object along the predetermined path, wherein said at least one stopper is provided in a vicinity of at least one of opposite ends of the predetermined path and engages, when the object is moved to said at least one end, the object and thereby stops the further movement of the object, wherein the linear scale is provided along the predetermined path, such that said at least one second scale portion of the linear scale is nearer to said at least one end of the predetermined path than said at least one first scale portion of the linear scale, so that when the object is moved to said at least one end, the object is moved from said at least one first path portion into said at least one second path portion, wherein the first predetermined distance is smaller than each of the first predetermined pitch and a reference pitch as the reference value, wherein the control device further includes a reference-position determining portion which detects at least one stop position where the further movement of the object is stopped by said at least one stopper, and which determines, based on the detected at least one stop position, at least one reference position of the object, wherein the reference-position determining portion includes:

a stop-position detecting portion which detects said at least one stop position, based on at least one of the plurality of detection signals; and a determining portion which determines said at least one reference position of the object, based on said at least one stop position detected by the stop- position detecting portion, wherein the control device further includes:

a driving-force obtaining portion which obtains, based on each of the obtained velocities of the object, a driving force of the driving device, and controls the driving device to produce the obtained driving force and thereby move the object;

an upper-limit selecting portion which selects, as a current upper limit of the driving force, one of at least one first upper limit and at least one second upper limit that correspond to said at least one first path portion and said at least one second path portion of the predetermined path, respectively, wherein said at least one second upper limit is smaller than said at least one first upper limit;

a driving-force limiting portion which limits the driving force to not higher than the current upper limit, and an object-movement judging portion which judges, based on a change of the obtained velocities of the object, whether the object has been moved from said at least one first path portion to said at least one second path portion, and wherein the upper-limit selecting portion changes, when the object-movement judging portion judges that the object has been moved from said at least one first path portion to said at least one second path portion, the current upper limit of the driving force from said at least one first upper limit thereof to said at least one second upper limit thereof.

15. The driving apparatus according to claim 14, wherein the object-movement judging portion includes a velocity-increase judging portion which judges whether an amount of the change of the obtained velocities is greater than a predetermined velocity-increase threshold value, and the object-movement judging portion judges, based on a first positive judgment that the amount of the change is greater than the predetermined velocity-increase threshold value, that the object has been moved from said at least one first path portion to said at least one second path portion.

16. The driving apparatus according to claim 15, wherein the object-movement judging portion further includes a velocity-increase-state-continuation judging portion which judges whether a continuation of a velocity-increase state in which the velocity-increase judging portion makes a plurality of said first positive judgments has satisfied a first predetermined condition, and wherein the object-movement judging portion judges, based on a second positive judgment that the continuation of the velocity-increase state has satisfied the first predetermined condition, that the object has been moved from said at least one first path portion to said at least one second path portion.

17. The driving apparatus according to claim 14, wherein the reference-position determining portion includes:

a velocity-decrease judging portion which judges whether an amount of the change of the obtained velocities of the object is smaller than a predetermined velocity-decrease threshold value; and a stopping judging portion which judges, based on a third positive judgment that the amount of the change is smaller than the predetermined velocity-decrease threshold value, that the object has been engaged with, and stopped by, said at least one stopper.

18. The driving apparatus according to claim 17, wherein the upper-limit selecting portion selects, as the current upper limit of the driving force, one of (a) said at least one first upper limit, (b) said at least one second upper limit, and (c) at least one impact-time upper limit corresponding to at least one time when the stopping judging portion has judged that the object has been stopped by said at least one stopper, and wherein the upper-limit selecting portion changes, when the stopping judging portion judges that the object has been stopped by said at least one stopper, the current upper limit of the driving force from said at least one second upper limit thereof to said at least one impact-time upper limit thereof.

19. The driving apparatus according to claim 17, wherein the control device changes, when the stopping judging portion judges that the object has been stopped by said at least one stopper, the driving force of the driving device to at least one first predetermined value.

20. The driving apparatus according to claim 17, wherein the reference-position determining portion further includes a velocity-decrease-state-continuation judging portion which judges whether a continuation of a velocity-decrease state in which the velocity-decrease judging portion makes a plurality of said third positive judgments has satisfied a second predetermined condition, and wherein the stopping judging portion judges, based on a sixth positive judgment that the continuation of the velocity-decrease state has satisfied the second predetermined condition, that the object has been stopped by said at least one stopper.

21. The driving apparatus according to claim 14, wherein the reference-position determining portion includes:

a predetermined-distance movement judging portion which judges whether the object has been moved over a predetermined distance after the object-movement judging portion has judged that the object has been moved from said at least one first path portion to said at least one second path portion; and a stopping judging portion which judges, based on a fourth positive judgment that the object has been moved over the predetermined distance, that the object has been engaged with, and stopped by, said at least one stopper.

22. The driving apparatus according to claim 21, wherein the upper-limit selecting portion selects, as the current upper limit of the driving force, one of (a) said at least one first upper limit, (b) said at least one second upper limit, and (c) at least one impact-time upper limit corresponding to at least one time when the stopping judging portion has judged that the object has been stopped by said at least one stopper, and wherein the upper-limit selecting portion changes, when the stopping judging portion judges that the object has been stopped by said at least one stopper, the current upper limit of the driving force from said at least one second upper limit thereof to said at least one impact-time upper limit thereof.

23. The driving apparatus according to claim 21, wherein the control device changes, when the stopping judging portion judges that the object has been stopped by said at least one stopper, the driving force of the driving device to at least one second predetermined value.

24. The driving apparatus according to claim 21, wherein the reference-position determining portion further includes a velocity-decrease judging portion which judges whether an amount of the change of the obtained velocities of the object is smaller than a predetermined velocity-decrease threshold value, and wherein the stopping judging portion judges, based on a fifth positive judgment that the amount of the change is smaller than the predetermined velocity-decrease threshold value, that the object has been stopped by said at least one stopper, irrespective of whether the predetermined-distance-movement judging portion makes the fourth positive judgment or a negative judgment.

25. A driving apparatus, comprising:

a driving device which moves an object along a predetermined path;

a linear encoder including a linear scale and a detector at least one of which is moved relatively to an other of the linear scale and the detector when the object is moved along the predetermined path by the driving device;

a control device which controls, based on an output of the detector, the driving device to move the object along the predetermined path; and at least one stopper on which the object impacts when the object is moved along the predetermined path, so that said at least one stopper stops a further movement of the object, wherein the linear scale includes (a) at least one first scale portion having at least one first detectable pattern having a first predetermined pitch, and (b) at least one second scale portion having at least one second detectable pattern having a first predetermined distance smaller than the first predetermined pitch, wherein said at least one first scale portion and said at least one second scale portion are located relative to each other such that when the object is moved toward said at least one stopper, the detector first detects said at least one first detectable pattern and then detects said at least one second detectable pattern, while sequentially outputting a plurality of detection signals, and the control device controls, based on the detection signals sequentially outputted by the detector, the driving device to move the object along the predetermined path, such that the object is moved at at least one first actual velocity in at least one first path portion of the predetermined path that corresponds to said at least one first scale portion and is moved at at least one second actual velocity lower than said at least one first actual velocity, in at least one second path portion of the predetermined path that corresponds to said at least one second scale portion until the object impacts on said at least one stopper at a reduced velocity less than said at least one first actual velocity, wherein said at least one second detectable pattern of said at least one second scale portion includes a plurality of third alternate portions and a plurality of fourth alternate portions, and wherein the third alternate portions include at least one first pair of adjacent third alternate portions which are distant from each other by the first predetermined distance, and at least one second pair of adjacent third alternate portions which are distant from each other by a second predetermined distance smaller than the first predetermined distance and which are nearer to said at least one stopper than said at least one first pair of adjacent third alternate portions.

26. The driving apparatus according to claim 25, wherein said at least one first scale portion include a plurality of first alternate portions arranged at the first predetermined pitch, and a plurality of second alternate portions which are arranged at the first predetermined pitch and are alternately arranged with the first alternate portions and each of which is physically distinguishable from each of the first alternate portions, and said at least one first detectable pattern of said at least one first scale portion include the first alternate portions and the second alternate portions, and wherein the plurality of fourth alternate portions are alternately arranged with the third alternate portions and each of which is physically distinguishable from each of the third alternate portions.

27. The driving apparatus according to claim 26, wherein the first alternate portions and the second alternate portions of said at least one first scale portion include a plurality of first slits formed at the first predetermined pitch, and a plurality of first light-reflecting portions which are provided at the first predetermined pitch and are alternately arranged with the first slits, and wherein the third alternate portions and the fourth alternate portions of said at least one second scale portion include a plurality of second slits, and a plurality of second light-reflecting portions which are alternately arranged with the second slits.

28. The driving apparatus according to claim 26, wherein said at least one second scale portion of the linear scale has at least three said third alternate portions provided at a second predetermined pitch smaller than the first predetermined pitch.

29. The driving apparatus according to claim 25, wherein said at least one second scale portion includes at least one of lengthwise opposite end portions of the linear scale.

30. The driving apparatus according to claim 25, wherein said at least one first scale portion of the linear scale is adjacent to said at least one second scale portion thereof.

31. A driving apparatus, comprising:

a driving device which reciprocatively moves an object along a predetermined path;

a linear encoder having (a) a linear scale which is provided along the predetermined path and which includes at least one first scale portion having a plurality of first detectable portions provided at a predetermined pitch, and (b)

a detector which is moved, when the object is moved by the driving device, so as to sequentially detect the first detectable portions and sequentially output a plurality of first detection signals each of which indicates a detection of a corresponding one of the first detectable portions;

a velocity calculating portion which calculates, each time a predetermined condition is met, a first velocity of the object, based on at least one of the first detection signals sequentially outputted by the detector; and a control portion which controls, based on the calculated first velocities of the object, the driving device to move the object along at least one first path portion of the predetermined path that corresponds to said at least one first scale portion;

at least one stopper which is provided in a vicinity of at least one of opposite ends of the predetermined path, and on which the object impacts when the object is moved to said at least one end;

an impaction detecting portion which detects that the object has impacted on said at least one stopper and a further movement of the object has been stopped by said at least one stopper; and a reference-position determining portion which detects, when the impaction detecting portion detects that the object has impacted on said at least one stopper, at least one stop position where the further movement of the object has been stopped by said at least one stopper, and which determines, based on the detected at least one stop position, at least one reference position of the object, wherein the linear scale has an actually detectable portion which corresponds to a reciprocative-movement portion of the predetermined path where the object can be reciprocatively moved by the driving device, and which includes, in addition to said at least one first scale portion, at least one second scale portion that is nearer to said at least one end of the predetermined path than said at least one first scale portion and that has a plurality of second detectable portions including a first pair of adjacent second detectable portions which are distant from each other by a first predetermined distance smaller than the predetermined pitch and a second pair of adjacent second detectable portions which are distant from each other by a second predetermined distance smaller than the first predetermined distance, and the detector sequentially detects the second detectable portions and sequentially outputs a plurality of second detection signals each of which indicates a detection of a corresponding one of the second detectable portions, wherein said second pair of adjacent second detectable portions is nearer to said at least one end of the predetermined path than said at least one first pair of adjacent second detectable portions, wherein the velocity calculating portion uses the predetermined pitch as a common pitch which is common to an entirety of the actually detectable portion of the linear scale, such that the velocity calculating portion calculates, based on the common pitch, the first velocity of the object based on said at least one of the first detection signals, and calculates, based on the common pitch, a second velocity of the object based on at least one of the second detection signals, and wherein the control portion controls, based on the calculated first and second velocities of the object, the driving device to move the object along the predetermined path, such that the object is moved at at least one first actual velocity in at least one first path portion of the predetermined path that corresponds to said at least one first scale portion and is moved at at least one second actual velocity lower than said at least one first actual velocity, in at least one second path portion of the predetermined path that corresponds to said at least one second scale portion until the object impacts on said at least one stopper at a reduced velocity less than said at least one first actual velocity.

* * * * *